US006688727B2

(12) United States Patent
Otsuki

(10) Patent No.: US 6,688,727 B2
(45) Date of Patent: Feb. 10, 2004

(54) PRINTER FOR SWITCHING SUB-SCAN FEED AT DOT RECORDING AREA AND BLANK AREA

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/213,488

(22) Filed: Aug. 6, 2002

(65) Prior Publication Data

US 2003/0035022 A1 Feb. 20, 2003

(30) Foreign Application Priority Data

Aug. 8, 2001 (JP) ..... 2001-241352
Jul. 18, 2002 (JP) ..... 2002-209357

(51) Int. Cl.[7] ..... B41J 2/15
(52) U.S. Cl. ..... 347/41; 347/15; 347/43
(58) Field of Search ..... 347/41, 15, 43, 347/16, 37, 14

(56) References Cited

U.S. PATENT DOCUMENTS 5,539,434 A 7/1996 Fuse
5,692,843 A 12/1997 Furuya ..... 347/41
6,209,987 B1 * 4/2001 Katayama ..... 347/43
6,612,685 B1 * 9/2003 Marra et al. ..... 347/41

FOREIGN PATENT DOCUMENTS

EP 0 475 696 A2/3 3/1992
EP 0 760 289 A2/3 3/1997
JP 05-246048 9/1993
JP 08-238805 9/1996
JP 08/238805 9/1996

OTHER PUBLICATIONS

Abstract of Japanese Patent Pub. No. 05–246048, Pub. Date: Sep. 24,1993, Patent Abstracts of Japan.
Abstract of Japanese Patent Pub. No. 08–238805, Pub. Date: Sep. 17,1996, Patent Abstracts of Japan.

* cited by examiner

*Primary Examiner*—Lamson D Nguyen
(74) *Attorney, Agent, or Firm*—Martine & Penilla, LLP

(57) ABSTRACT

Dot recording areas Rr1, Rr2, Rr3 in which dots are to be formed, and blank areas Rb1, Rb2 in which dots are not formed exist on the printing paper. When the recording of dots in dot recording area Rr2 is finished on the fourth pass, a positioning sub-scan feed of feed amount SSp1 is performed. In accordance with this positioning sub-scan feed SSp1, the print head is relatively sent to a relative position, where nozzle #1 is positioned above the 32nd line, which is the main scan line at the upper end of the third dot recording area. By carrying out a positioning sub-scan feed such as this, it is possible to shorten the time required for printing compared to when an inter-band sub-scan of a feed amount SSb1 of six dots is also executed in blank area Rb2.

42 Claims, 22 Drawing Sheets

PRINTER FOR SWITCHING SUB-SCAN FEED AT DOT RECORDING AREA AND BLANK AREA

BACKGROUND OF THE INVENTION

1 Field of the Invention

The present invention relates to a technique for performing printing by forming dots on a printing medium while carrying out a main scan, and more particularly to a technique for performing printing, which contains a dot recording area, a blank area and a dot recording area in the sub-scan direction on the printing paper.

2. Description of the Related Art

In recent years, the type of printer, which ejects ink from a print head, has come into widespread use as an output device for computers. Among such printers, there are those that print images by forming dots on a printing medium by ejecting drops of ink from nozzles while executing a main scan. And printers such as this print images on printing paper by executing sub-scans between main scans.

In this type of printer, the following technique is known as a technique used to print images in which dot recording area, blank area and dot recording area are aligned in the sub-scanning direction. In this technique, dots are recorded in a single main scan on as many lines as there are nozzles which are aligned in the sub-scanning direction on a printing head. Then, sub-scanning is carried out only to the extent of the width of the areas in which recording of the dots has been completed. Another main scan is carried out and dots are recorded on as many lines as there are nozzles. Then, the dots continue being recorded one after another in a width area corresponding to the number of nozzles on the printing paper. The bundle of lines which can be recorded in a single main scan will be referred to hereafter as "recording band". When there are no dots to be recorded on the recording band scheduled to be recorded next, this printer records the dots on the recording band scheduled to be recorded after that, without a main scan on the recording band scheduled to be recorded next.

When this printer is used, the amount of feed for the sub-scan is usually the width of the recording band. When there are no dots to be recorded in a specific area on the printing paper, sub-scan feeding equivalent to n times (n is an integer of 1 or greater) the width of the recording band is carried out up to the position of the recording band which includes the dots to be recorded and the dots are then recorded.

The amount of sub-scan feed in the printer mentioned above is limited to the feed amount equivalent to n times (n is an integer of 1 or greater) the width of the recording band. Therefore, in printing images, in which the dot recording area, the blank area and the dot recording area are aligned in the sub-scan direction, the sub-scanning could not be carried out efficiently.

SUMMARY OF THE INVENTION

The present invention was designed to solve for the above-mentioned problems of the prior art. An object [of the present invention] is to efficiently perform printing, in which a dot recording area, a blank area and a dot recording area are lined up in the sub-scan direction on the printing paper.

To solve at the least a portion of the above-mentioned problems, the present invention carries out predetermined processing intended for a printing apparatus, which performs printing by forming dots by ejecting drops of ink from nozzles and depositing same on a printing medium. This printing apparatus comprises a print head which has a nozzle group comprising N (where N is an integer of 2 or greater) nozzles for ejecting drops of ink which are arrayed at a nozzle pitch D which is equivalent to the main scan line pitch D; a main scan driving unit for performing a main scan which moves at least one of the print head and the printing medium; a sub-scan driving unit for performing a sub-scan which moves at least one of the print head and the printing medium in a sub-scan direction that intersects with a direction of the main scan; and a control unit for controlling the print head, the main scan driving unit and the sub-scan driving unit.

With such printing apparatus, the printing is performed such that a first dot recording area in which dots are to be formed, a blank area in which dots are not formed, and a second dot recording area in which dots are to be formed exist in order on the printing medium in the sub-scan direction. A unit scan operation which comprises a single main scan is performed for forming dots on main scan lines of the first dot recording area, while executing an inter-band sub-scan according to a predetermined feed amount SSb between the respective unit scan operations. After completing the forming of dots in the first dot recording area, a positioning sub-scan feed is carried out for executing a sub-scan to obtain a relative position at which a position of an upper end nozzle of the N nozzles coincides with a position of an upper end main scan line of the second dot recording area in the sub-scan direction. Using such a mode makes it possible to shorten the time required for printing, and to perform printing efficiently.

It is preferable that the positioning sub-scan feed is executed only when a specific main scan line is included in the blank area and a number of main scan lines Lr is N or more. The specific main scan line is positioned below and adjacent to a main scan line where a lower end nozzle of nozzles used in the unit scan operation is positioned when an unit scan operation executed immediately before the positioning sub-scan has ended. The Lr is a number of main scan lines counted from the specific main scan line to a main scan line at a lower end of the blank area. Using such a mode makes in possible to reduce the number of sub-scans when printing on a printing medium.

A feed amount of the positioning sub-scan feed may be $(SSb+Lr)\times D$. Further, Lr can also be a value other than the value of an integral multiple of N. That is, when n is an integer of 0 or greater, and $\alpha$ is a positive integer of less than N, Lr can take a value that satisfies the equation $Lr=n\times N+\alpha$.

Furthermore, when printing is performed using a plurality of nozzle groups, each comprising a plurality of nozzles, each of which is a nozzle for ejecting drops of ink, and these nozzles are arrayed at a nozzle pitch D that is equivalent to the main scan line pitch D, it is also possible to perform printing such as the following. The plurality of nozzle groups includes a lower end nozzle group is a nozzle group whose upper end nozzle is positioned at a lowermost place among upper end nozzles of the plurality of nozzle groups. A positioning sub-scan feed may be carried out for executing a sub-scan to obtain a relative position at which a position of an upper end nozzle of the lower end nozzle group coincides with a position of an upper end main scan line of the second dot recording area in the sub-scan direction. Using a mode such as this, whether the nozzle group is disposed in a location so as to be lined up in the direction of the main scan, and whether the nozzle group is disposed in a different location in a sub-scan direction that intersects with a direction of the main scan, it is possible to record dots without gaps from the upper end of the second dot recording area.

The feed amount of the positioning sub-scan feed may be decided as follows. (i) A parameter i is set at one. (ii) It is determined whether or not an aggregate of main scan lines contains a pixel to be recorded with an ink dot. The aggregate of main scan lines are lines that are to be printed by the nozzle groups when it is assumed that a sub-scan of feed amount of (SSb×i) and the unit scan operation are to be executed. (iii) The parameter i is incremented by one. The operations (ii) and (iii) are repeated until the aggregate of main scan lines containing a pixel to be recorded is found.

Then a number of inner-band blank lines is counted. The inner-band blank lines are lines in the aggregate of main scan lines to be decided to contain a pixel to be recorded a dot, and are consecutive main scan lines that do not contain a pixel to be recorded with an ink dot and are lined up without gaps in the sub-scan direction from a top of the aggregate of main scan lines. The positioning sub-scan feed of feed amount $\{SSb\times(i_0-1)+j_0\}$ is executed. The "$i_0$" is the i when the aggregate of main scan lines containing a pixel to be recorded is found and the "$j_0$" is a number of the inner-band blank lines. With such a mode, the feed amount of the positioning sub-scan feed can be decided by studying the pixels in the unit of the aggregation of main scan lines that may be recorded dot in one unit scan operation.

The nozzle groups may be positioned such that they do not overlap one another in a direction perpendicular to the direction of the main scan, and may comprise p (where p is an integer of 2 or greater) nozzle groups for ejecting drops of ink of mutually different colors. Since using such a mode establishes the sequence by which drops of ink of each color are deposited on printing paper during printing, printing results are of high quality.

The p nozzle groups each may comprise N (where N is an integer of 2 or greater) nozzles. The nozzles included in each of the p nozzle groups may be arranged at a fixed nozzle pitch D in the direction perpendicular to the direction of the main scan. In such an embodiment, it is preferable that the positioning sub-scan feed is only executed when a width of the blank area in the direction perpendicular to the direction of the main scan is greater than $\{N\times(p-1)\}\times D$. Using a mode such as this enables the feed amount of a positioning sub-scan feed to be made longer that the feed amount of an inter-band sub-scan.

A feed amount of a positioning sub-scan feed may be $\{Lrt-N\times(p-2)\}\times D$. The Lrt represents a number of main scan lines counted as follows. The p nozzle groups include an upper end nozzle group including an uppermost nozzle of nozzles used in the unit scan operation. It is counted from a main scan line immediately below to a main scan line where a lower end nozzle of the upper end nozzle group is positioned in a state where a unit scan operation executed immediately before the positioning feed has ended. The number Lrt is counted to a main scan line of a lower end of the blank area. Using a mode such as this makes it possible to record dots without gaps from the upper end of the second dot recording area.

Further, efficient printing can also be performed by carrying out prescribed processing in a printing apparatus such as that hereinbelow. The printing apparatus has a print head which has a nozzle group comprising N (where N is an integer of 2 or greater) nozzles for ejecting drops of ink which are arrayed at a nozzle pitch k×D that is k times (where k is an integer of 2 or greater) a main scan line pitch D.

A unit scan operation is preferably performed for forming dots on main scan lines of the first dot recording area. The unit scan operation comprises k main scans and (k−1) sub-scans executed between the respective main scans by a predetermined first feed amount SSm, while executing inter-band sub-scans by a predetermined second feed amount SSb between unit scan operations. Then after completing the forming of dots in the first dot recording area, a positioning sub-scan feed may preferably be carried out for executing a sub-scan to obtain a relative position where an upper end main scan line of a unit band coincides with a main scan line of an upper end of the second dot recording area. The unit band is a bundle of consecutive main scan lines lined up without gaps in the sub-scan direction that are to be printed by the nozzle group when it is assumed that the unit scan operation is executed once after the positioning sub-scan feed. Using a mode such as this makes it possible to shorten the time required for printing and to perform printing efficiently, when performing printing such that the main scan line pitch is a fraction of the nozzle pitch.

It is preferable that the positioning sub-scan feed is executed only when a specific main scan line is included in the blank area and a number of main scan lines Lr is N×k or more. The specific main scan line is positioned below and adjacent to a main scan line where a lower end nozzle of nozzles used in the unit scan operation is positioned when an unit scan operation executed immediately before the positioning sub-scan has ended. The Lr is a number of main scan lines counted from the specific main scan line to a main scan line at a lower end of the blank area. Using a mode such as this makes it possible to reduce the number of sub-scans when printing on a printing medium.

A feed amount of the positioning sub-scan feed is preferably be (SSb+Lr)×D. Further, Lr can also be a value other than the value of an integral multiple of SSb. That is, when n is an integer of 0 or greater, and $\alpha 2$ is a positive integer of less than SSb, Lr can take a value that satisfies the equation $Lr=n\times SSb+\alpha 2$.

The print head may have a plurality of nozzle groups each comprising a plurality of nozzles for ejecting drops of ink which are arrayed at a nozzle pitch k×D that is k times (where k is an integer of 2 or greater) a main scan line pitch D. The plurality of nozzle groups includes a lower end nozzle group whose upper end nozzle is positioned at a lowermost place among upper end nozzles of the plurality of nozzle groups. Using a mode such as this can also make it possible to shorten the time required for printing and to perform printing efficiently, when performing printing such that the main scan line pitch is a fraction of the nozzle pitch.

The feed amount of the positioning sub-scan feed may be decided as follows. (i) A parameter i is set at one. (ii) It is determined whether or not an aggregate of main scan lines contains a pixel to be recorded with an ink dot. The aggregate of main scan lines are lines that are to be printed by the nozzle groups when it is assumed that a sub-scan of feed amount of $\{SSb\times i+SSm\times(k-1)\times(i-1)\}$ and the unit scan operation are to be executed. (iii) The parameter i is incremented by one. The operations (ii) and (iii) are repeated until the aggregate of main scan lines containing a pixel to be recorded is found.

Then a number of inner-band blank lines is counted. The inner-band blank lines are lines in the aggregate of main scan lines to be decided to contain a pixel to be recorded a dot, and are consecutive main scan lines that do not contain a pixel to be recorded with an ink dot and are lined up without gaps in the sub-scan direction from a top of the aggregate of main scan lines. The positioning sub-scan feed of feed amount $\{SSb+SSm\times(k-1)\}\times(i_0-1)+j_0$ is executed. The "$i_0$" is the i when the aggregate of main scan lines containing a pixel to be recorded is found and the "$j_0$" is a number of the inner-band blank lines. With such a mode, the feed amount of the positioning sub-scan feed can be decided by studying the pixels in the unit of the aggregation of main scan lines that may be recorded dot in one unit scan operation.

The nozzle groups may be positioned such that they do not overlap one another in a direction perpendicular to the direction of the main scan, and comprise p (where p is an integer of 2 or greater) nozzle groups for ejecting drops of ink of mutually different colors.

The p nozzle groups each may comprise N (where N is an integer of 2 or greater) nozzles, and the nozzles included in each of the p nozzle groups may be arranged at a fixed nozzle pitch k×D in the direction perpendicular to the direction of the main scan. In such a case, it is preferable that the positioning sub-scan feed is only executed when a width of the blank area in the direction perpendicular to the direction of the main scan is greater than $\{N\times k\times(p-1)\}\times D$. Using a mode such as this enables the feed amount of a positioning sub-scan feed to be made longer than the feed amount of an inter-band sub-scan, when performing printing such that the main scan line pitch is a fraction of the nozzle pitch.

In above embodiment, a feed amount of a positioning sub-scan feed is preferably be $\{Lrt-N\times k\times(p-2)\}\times D$. Using a mode such as this makes it possible to record dots without gaps from the upper end of the second dot recording area, when performing printing such that the main scan line pitch is a fraction of the nozzle pitch.

Furthermore, the present invention can be achieved using a variety of modes, such as those shown hereinbelow.

(1) Printing method, printing control method (2) Printing apparatus, printing control apparatus (3) A computer program for realizing the above-mentioned devices and methods.

(4) A recording medium on which is recorded a computer program for realizing the above-mentioned devices and methods.

(5) Data signals, which comprise a computer program for realizing the above-mentioned devices and methods, and which are embodied inside a carrier wave.

DESCRIPTION OF THE PREFERRED EMBODIMENTS

Next, aspects of the embodiments of the present invention will be explained in the following order based on the embodiments.

A. First Embodiment:

A1. Constitution of Device:

A2. Printing:

B. Second Embodiment

C. Third Embodiment

D. Fourth Embodiment

E. Fifth Embodiment

F. Sixth Embodiment

G. Seventh Embodiment

H. Variation:

A. Overview

Figure 1:
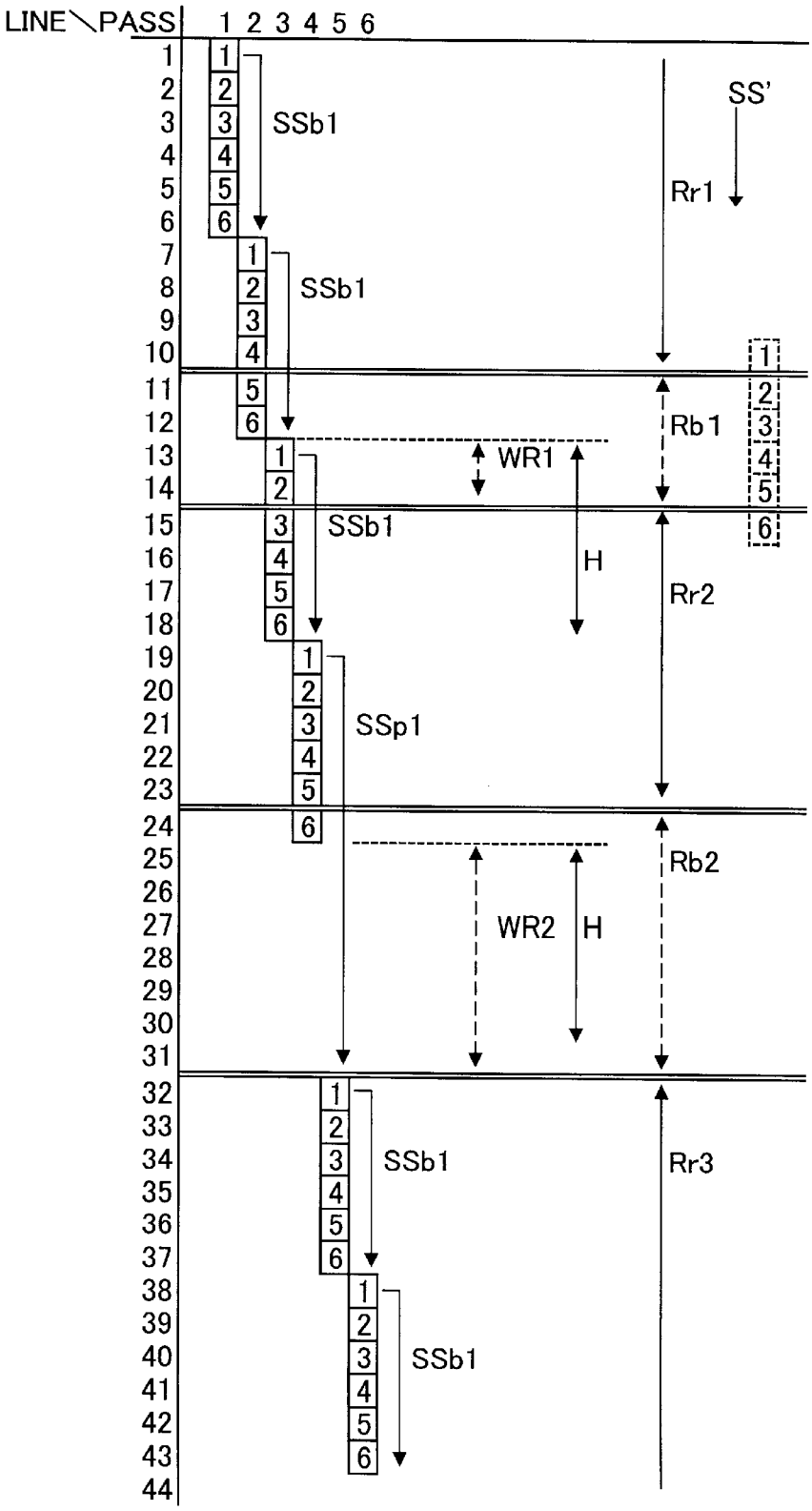
FIG. 1 is a schematic diagram showing how image data comprising dot recording areas and blank areas is recorded.

FIG. 1 is a schematic diagram showing how image data comprising dot recording areas and blank areas is recorded. As shown in FIG. 1, a first dot recording area Rr1 in which dots are to be formed, a first blank area Rb1 in which dots are not formed, a second dot recording area Rr2 in which dots are to be formed, a second blank area Rb2 in which dots are not formed, and a third dot recording area Rr3 in which dots are to be formed exist in order on the printing paper in the sub-scan direction SS'. At printing time, a main scan is executed while drops of ink are being ejected from each of nozzles #1 through #6 shown as one vertical row, and in a single main scan records dots in six adjacent main scan lines in the sub-scan SS' direction. Then, an inter-band sub-scan of a feed amount SSb1 of six dots is executed at the interval between each main scan.

When dots have been recorded in all of the main scan lines of the second dot recording area Rr2 by the respective passes up to the fourth pass, a positioning sub-scan feed of feed amount SSp1 is carried out. The print head is moved relatively by this positioning sub-scan feed SSp1 to a relative position at which upper end nozzle #1 is positioned above the 32nd line, which is the main scan line of the upper end of the third dot recording area Rr3. By performing a positioning sub-scan feed such as this, it is possible to shorten the time required for printing compared to when an inter-band sub-scan of a feed amount SSb1 of six dots is executed in blank area Rb2 as well.

Figure 2:
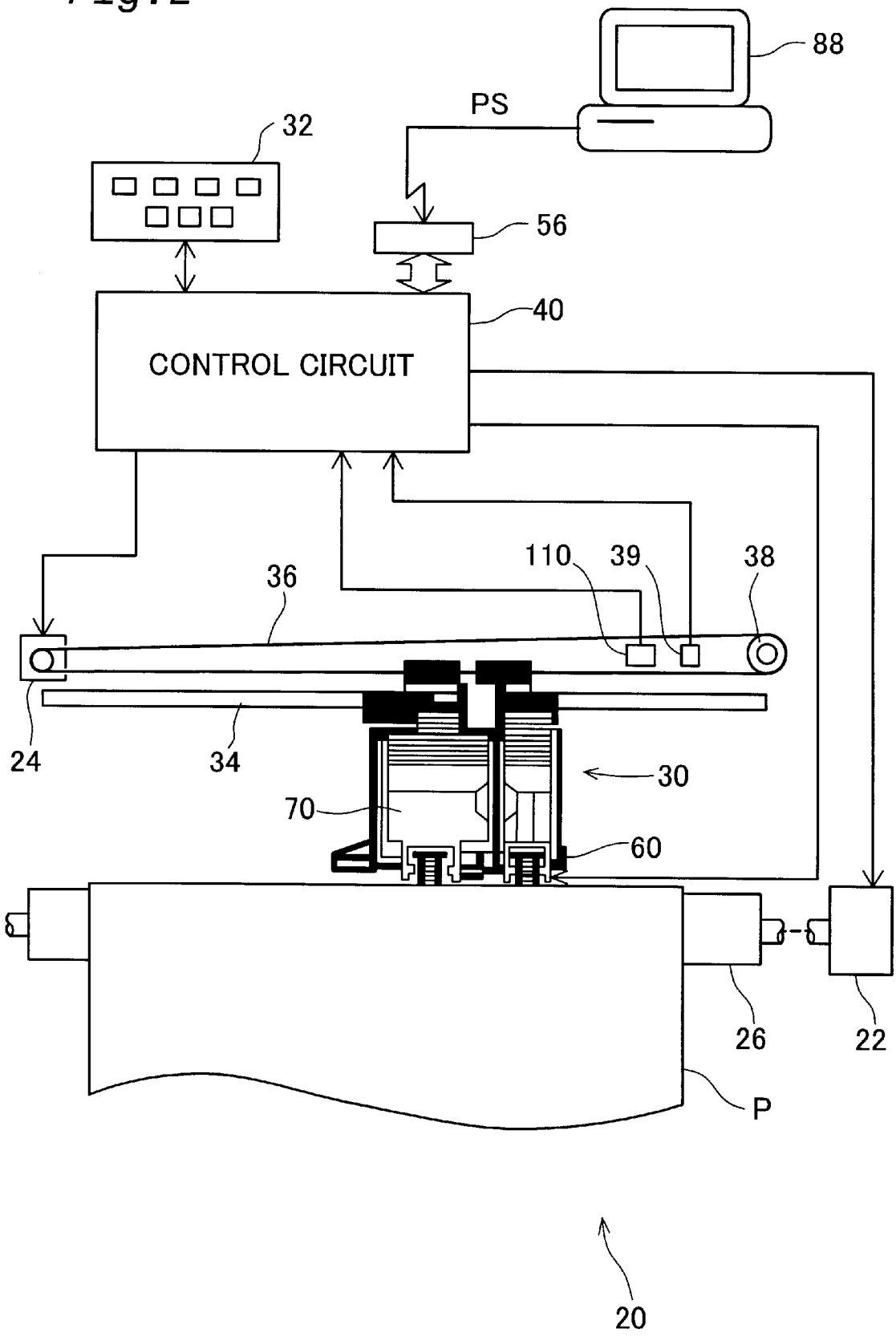
FIG. 2 is a simplified block diagram of a printing system comprising an ink jet printer 20 as a first embodiment.

A. First Embodiment:

A1. Constitution of Device:

FIG. 2 is a simplified block diagram of a printing system comprising an ink jet printer 20 as an embodiment of the present invention. This printer 20 comprises a main scan feed mechanism, which moves a carriage 30 back and forth along a sliding axis 34 by virtue of a carriage motor 24; a sub-scan feed mechanism, which feeds printing paper p in a direction perpendicular to the direction of a main scan (called the "sub-scan direction") by virtue of a paper feed motor 22; a head driving mechanism, which drives a print head unit 60 mounted in the carriage 30 and controls ink ejection and dot formation; and a control circuit 40, which manages the exchange of signals between the paper feed motor 22, carriage motor 24, print head unit 60, and a control panel 32. Control circuit 40 is connected to a computer 88 by way of a connector 56.

The sub-scan feed mechanism for feeding printing paper P comprises a gear train (not shown in the figure) for transferring the rotation of paper feed motor 22 to a paper feed roller (not shown in the figure). Further, the main scan feed mechanism for moving carriage 30 back and forth comprises a sliding axis 34, which is provided in a hanging condition in a direction that is perpendicular to the feed direction of the printing paper P, and which maintains the carriage 30 in a slidable condition; a pulley 38, which provides an endless drive belt 36 in a tensioned state between itself and carriage motor 24; and a position sensor 39 for detecting the home position of carriage 30.

Figure 3:
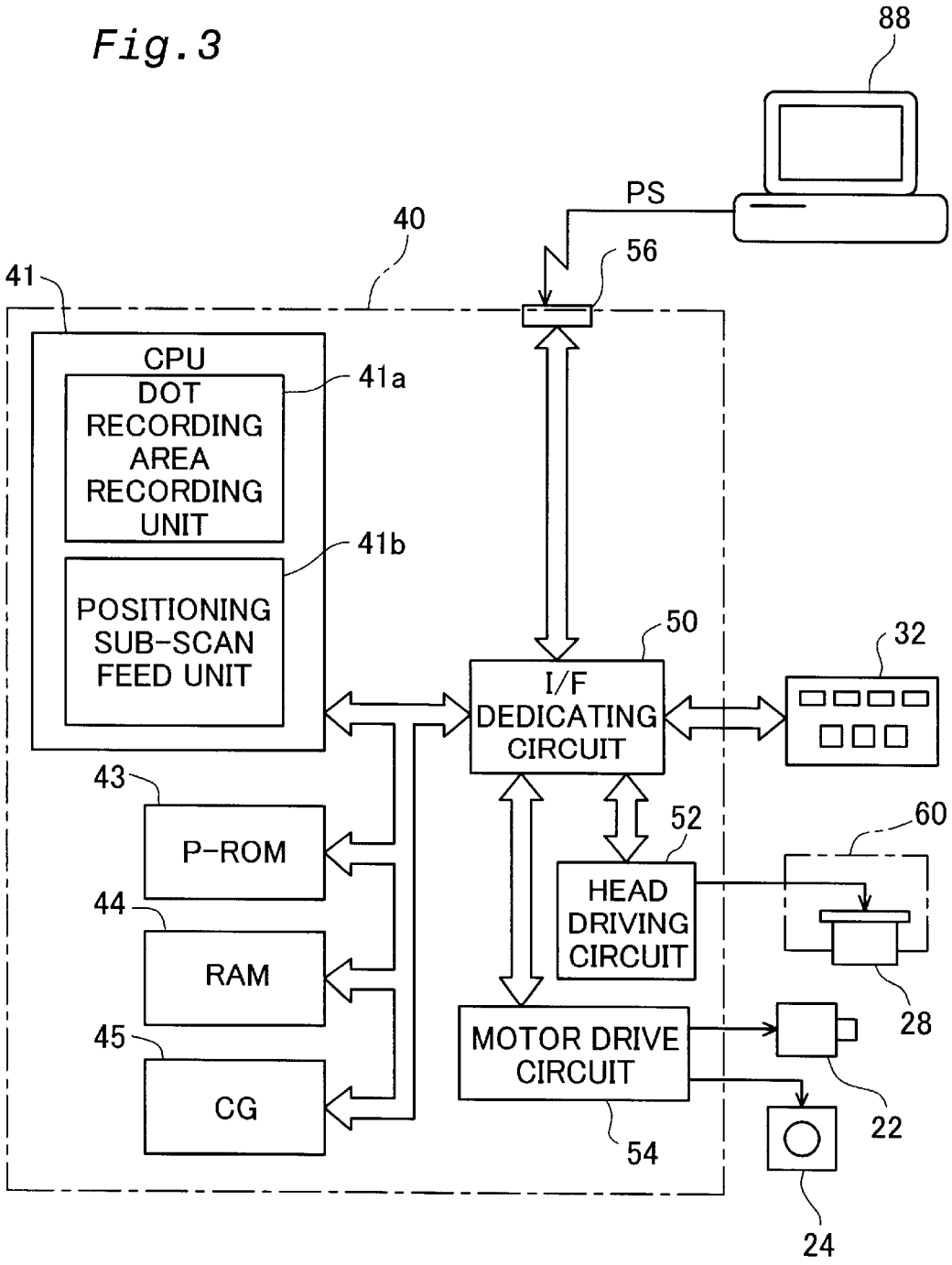
FIG. 3 is a block diagram showing each component element of printer 20 with priority given to control circuit 40.

FIG. 3 is a block diagram showing each component element of printer 20 with priority given to control circuit 40. Control circuit 40 is constituted as an arithmetic and logic unit comprising a CPU 41, programmable ROM (PROM) 43, RAM 44, and a character generator (CG) 45, which stores the dot matrix for characters. This control circuit 40 further comprises an interface (I/F) dedicating circuit 50 for interfacing dedicatedly with external motors and other devicesg; a head driving circuit 52, which is connected to this I/F dedicating circuit 50, and which drives print head unit 60 and causes ink to be ejected; and a motor drive circuit 54 for driving paper feed motor 22 and carriage motor 24. I/F dedicating circuit 50 is equipped with a parallel interface circuit, and can receive print signals PS supplied from computer 88 via connector 56. Furthermore, CPU 41 functions as a dot recording area recording unit 41*a* and a positioning sub-scan feed unit 41*b*, which will be explained hereinbelow, by executing a computer program stored in PROM 42.

Print head 28 has a plurality of nozzles n, which is provided [such that there is] one row for each color, and an actuator circuit 90, which operates a piezoelectric device PE disposed in each nozzle n. Actuator circuit 90 is one part of head driving circuit 52 (refer to FIG. 3), and turns ON and OFF drive signals, which are furnished from a not-shown drive signal generating circuit inside head driving circuit 52. That is, actuator circuit 90 latches data indicating either ON (eject ink) or OFF (do not eject ink) for each nozzle in accordance with print signals PS supplied from computer 88, and applies a drive signal to a piezoelectric device PE only for an ON nozzle.

Figure 4:
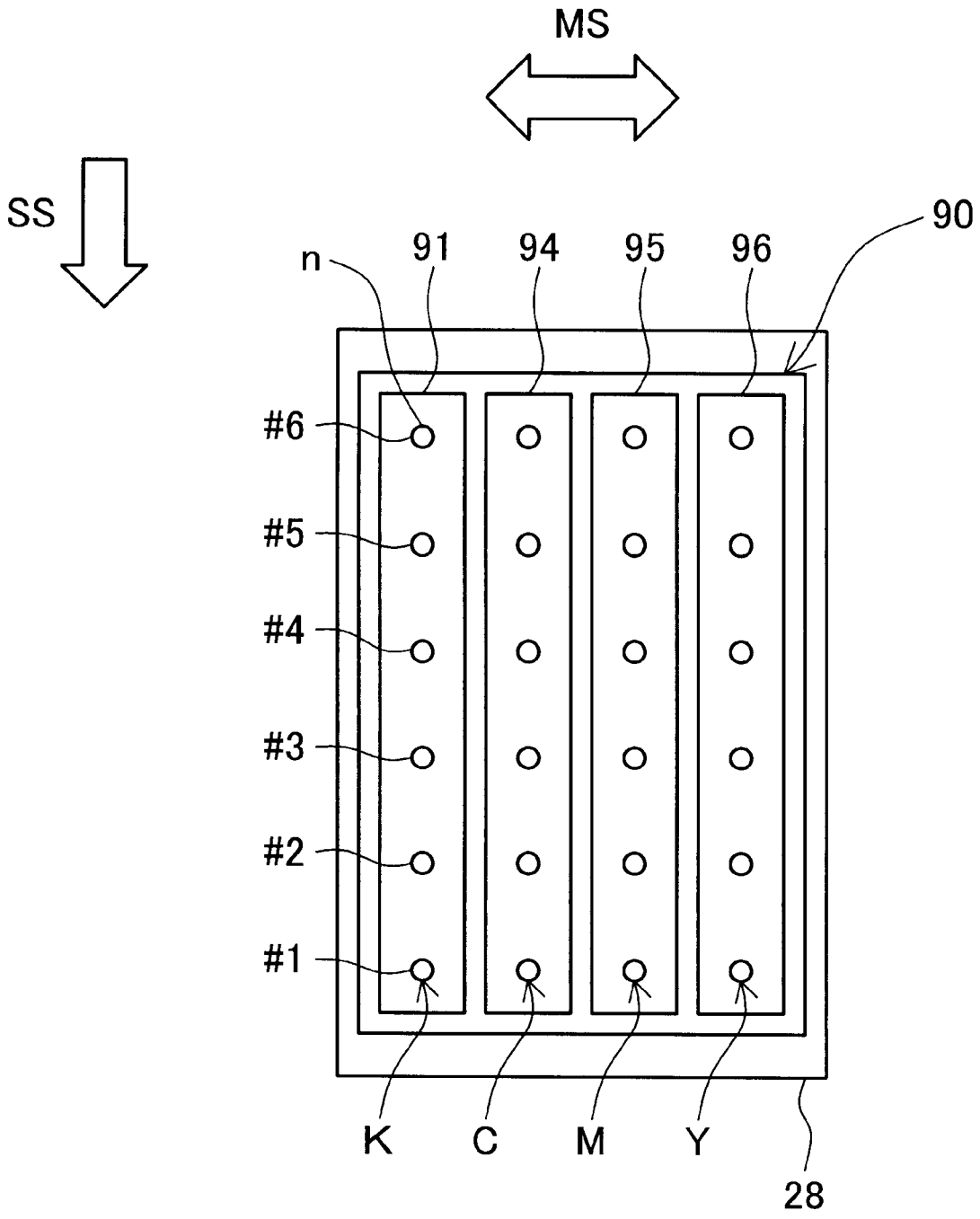
FIG. 4 is a schematic diagram showing the arrangement of nozzles disposed in print head 28.

FIG. 4 is a schematic diagram showing the arrangement of nozzles disposed in print head 28. Printer 20 is a printing apparatus for carrying out printing using four colors of ink, black (K), cyan (C), magenta (M), and yellow (Y). This printer 20 comprises six nozzles for each color. The nozzles for each color are provided at mutually equivalent pitches in the main scan direction.

In actuator circuit 90, there are provided an actuator chip 91 for driving the black nozzle row K; an actuator chip 94 for driving the cyan nozzle row C; an actuator chip 95 for driving the magenta nozzle row M; and an actuator chip 96 for driving the yellow nozzle row Y.

Print head 28 is moved back and forth in the direction of arrow MS along sliding axis 34 by carriage motor 24. Then, printing paper P is fed in the direction of arrow SS relative to print head 28 by paper feed motor 22.

A2. Printing:

How image data comprising dot recording areas and blank areas is recorded will be explained using FIG. 1. In the left side of FIG. 1, the number of each main scan line is shown, and at the top, the pass number is shown. Furthermore, one main scan is called a "pass." Image data printed via the first embodiment comprises a first dot recording area in which dots are to be formed, a first blank area in which dots are not formed, a second dot recording area in which dots are to be formed, a second blank area in which dots are not formed, and a third dot recording area in which dots are to be formed. As a result of this, as shown in FIG. 1, a first dot recording area Rr1 in which dots are to be formed, a first blank area Rb1 in which dots are not formed, a second dot recording area Rr2 in which dots are to be formed, a second blank area Rb2 in which dots are not formed, and a third dot recording area Rr3 in which dots are to be formed will exist in order in the sub-scan direction on the printing paper on which this image is printed. Furthermore, in FIG. 1, the sub-scan direction is indicated by arrow SS'.

In the example of FIG. 1, the first through the 10th lines are the first dot recording area Rr1, the 11th through the 14th lines are the first blank area Rb1, and the 15th through the 23rd lines are the second dot recording area Rr2. Then, the 24th through the 31st lines are the second blank area Rb2, and the 32nd line and beyond are the third dot recording area Rr3.

In FIG. 1, the print head is represented by six squares lined up in the vertical direction. And to simplify the explanation for FIG. 1, only one row of the six rows of nozzles is shown. Also, in reality, printing paper P is fed relative to the print head, and the relative position of both will change, but to simplify the explanation for FIG. 1, the print head is displayed such that it will move downwardly relative to the printing paper P. Arrow SS' indicates the relative direction of movement of the print head. The orientation of arrow SS' is opposite that of the printing paper feed orientation SS (refer to FIG. 4). Also, in FIG. 1, the drive head is shown as shifting to the right each time a sub-scan is performed.

Furthermore, in the present specification, when the recording of each main scan line is explained, and when the position of each nozzle is explained, the leading edge direction when printing paper is being fed by paper feed motor 22 is called "top," and the trailing edge direction is called "bottom." This top and bottom naming coincides with the top and bottom of FIG. 1.

Figure 5:
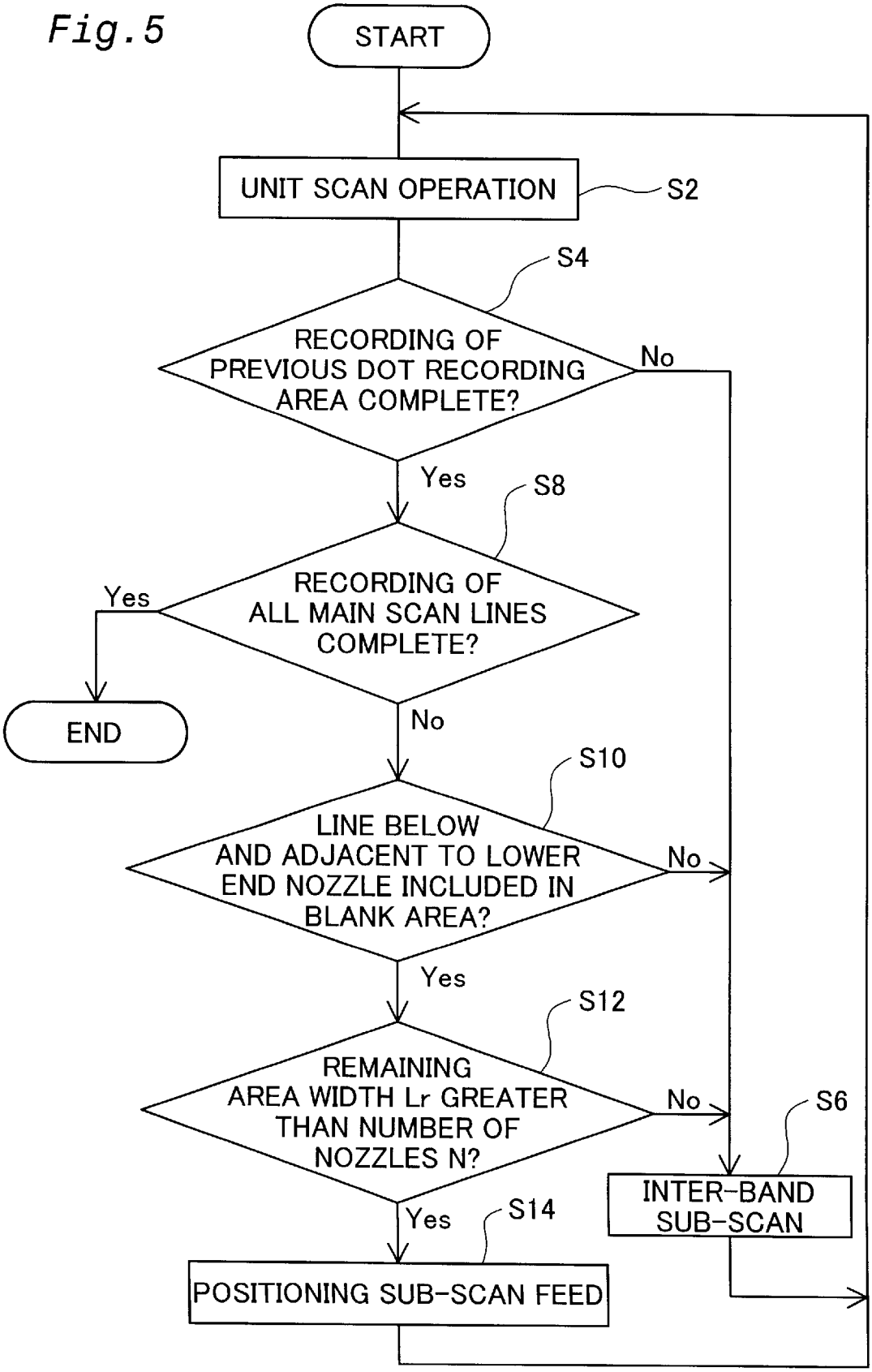
FIG. 5 is a flowchart showing a printing procedure.

FIG. 5 is a flowchart showing a printing procedure. At printing time, first, a unit scan operation is executed in Step S2. In the first embodiment, a "unit scan operation" is an operation whereby a main scan is performed once while ejecting drops of ink from each of nozzles #1 through #6 and forming dots on the main scan lines in accordance with image data. In Step S2, first, dots are recorded on the first through the sixth lines of the first dot recording area by the first pass executed as a unit scan operation. In the first embodiment, because a unit scan operation comprises one main scan, each pass corresponds to one unit scan operation, respectively.

When the first pass is finished, a determination is made in Step S4 as to whether or not the recording for the first dot recording area, which was recorded by the unit scan operation of the previous Step S2, has been completed. In Step S4, for example, a determination that "the recording of the dot recording area, which was recorded by the previous unit scan operation, is finished" can be made as follows. The determination can be made in case that there is no data for to-be-recorded dots in the data of the upper end main scan line in the main scan line group which is targeted for dot recording when it is supposed that the next unit scan operation will be executed. In a state, wherein the first pass is finished, because dots have yet to be recorded in the seventh through the tenth lines of the first dot recording area Rr1, the result of the determination in Step S4 becomes "No."

When the result of the determination in Step S4 is "No," an inter-band sub-scan of feed amount SSb1 is executed in Step S6. Inter-band sub-scan feed amount SSb1, as shown in FIG. 1, is six dots. Furthermore, "one dot," which is the unit that represents the distance in the sub-scan direction, is the pitch of adjacent main scan lines. In the first embodiment, since the nozzle pitch and the main scan line pitch are equivalent, the inter-band sub-scan feed amount SSb1, which is expressed in number of dots, is equivalent to the number of nozzles N. Step S2, S4 and S6 printing such as this is executed by the dot recording area recording unit 41*a* (refer to FIG. 3) of CPU 41.

Next, a unit scan operation is carried out once again in Step S2. This unit scan operation is the second pass in FIG. 1. In this second pass, as shown in FIG. 1, the seventh through the tenth lines are recorded. In the second pass, 11th line and 12th line recording is also possible, but since these main scan lines are main scan lines belonging to the first blank area Rb1 dots are not recorded on these lines.

When the second pass is complete, a determination is made in Step S4 as to whether or not the recording of the first dot recording area is finished. In a state, wherein the second pass has been completed, since all the main scan lines on the first dot recording area have been recorded, the result of the determination becomes "Yes."

When the result of the determination in Step S4 is "Yes," a determination is made in Step S8 as to whether or not the recording of all the main scan lines has been completed. Following the data of all main scan lines comprising a single page, a signal representing the end of the data of the page is contained in the print signals PS. When the next unit scan operation is supposed to be implemented, CPU 41 makes a determination that "the recording of all the main scan lines has been complete" in case as follows. That is the case that there is a signal representing the end of the data of the page at the end of the data of the main scan line group, which is targeted for dot recording when it is supposed that the next unit scan operation will be executed. In a state, wherein the second pass in FIG. 1 has been completed, since the recording of the second dot recording area Rr2 and the third dot recording area Rr3 has not yet to be completed, the result of the determination is "No."

When the result of the determination in Step S8 was "No," in Step S10, a determination is made as to whether or not the specific main scan line is a main scan line comprising a blank area. The specific main scan line is a main scan line that is positioned below and adjacent of the main scan line on which lower end nozzle #6 is positioned when the unit scan operation executed in the previous Step S2 is over. In a state, wherein the second pass is over, nozzle #6, which is positioned at the lower end of the nozzle row, is positioned on the 12th line. Then, the 13th line of below and adjacent thereto comprises the first blank area Rb1. Accordingly, the result of the determination of Step S10 becomes "Yes."

Meanwhile, as indicated by the broken line in the right side of FIG. 1, for example, when the main scan line (16th line), which is positioned below and adjacent of the main scan line (15th line) on which nozzle #6 is positioned is in a dot recording area, the result of the determination of Step S10 becomes "No." In this case, once again an inter-band sub-scan of feed amount SSb1 is carried out in Step S6, and a unit scan operation is performed in Step S2.

When the result of the determination of Step S10 is "Yes," a determination is subsequently made in Step S12. In Step S12, a determination is made as to whether or not the number of main scan lines Lr of area WR, from the main scan line immediately below to nozzle #6 to the main scan line of the lower end of the blank area, is greater than the number of nozzles N comprising a nozzle row. In the first embodiment, because the main scan line pitch is equivalent to the nozzle pitch, it is also possible to make a determination in Step S12 as to whether or not the number of main scan lines Lr of blank area (hereinafter referred to as "remaining area") WR below nozzle #6 is greater than the width H in which a nozzle row is provided in the sub-scan direction.

In a state, wherein the second pass has been completed, the main scan line immediately below to nozzle #6 is the 13th line, and the main scan line at the lower end of the first blank area Rb1 is the 14th line. Accordingly, the number of main scan lines Lr in the remaining area WR is two lines. This area is labeled WR1 in FIG. 1. In relation to this, there are six nozzles, that is, the width of the nozzle row in the sub-scan direction is six lines. Thus, the result of the determination of Step S12 is "No." Furthermore, for the sake of comparison, the width within which nozzles are disposed in the sub-scan direction is indicated in FIG. 1 by arrow H, which starts at the 13th line. When the result of the determination of Step S12 is "No," once again an inter-band sub-scan is executed in Step S6, and a unit scan operation is performed in Step S2.

Thereafter, a third pass and a fourth pass are executed in accordance with the procedures of Steps S2 through S6. In the third pass, as shown in FIG. 1, the 15th through the 18th lines are recorded. And in the fourth pass, the 19th through the 23rd lines are recorded. In the third pass, the 13th and 14th lines can also be recorded, but since these main scan lines belong to the first blank area Rb1, dots are not recorded on these lines. Further, in the fourth pass, recording is also possible on the 24th line, but because the 24th line is a main scan line, which belongs to the second blank area Rb2, dots are not recorded on the line.

Once the fourth pass executed as the unit scan operation of Step S2 is over, a determination is made in Step S4 as to whether or not the recording of the dot recording area is complete. Since the recording of the second dot recording area Rr2 has been completed by the respective passes up to the fourth pass, the result of the determination of Step S4 is "Yes." Then, the result of the determination in Step S8 made thereafter becomes "No" since the recording of the third dot recording area Rr3 is not complete.

When the result of the determination in Step S8 was "No," a determination is made in Step S10 as to whether or not the main scan line below and adjacent to the main scan line where nozzle #6 is positioned is a main scan line comprising a blank area. In the state subsequent to the fourth pass, the line below and adjacent to nozzle #6 is the 25th line. Since the 25th line is included in the second blank area Rb2, the result of the determination of Step S10 is "Yes."

In Step S12 that follows, a determination is made as to whether or not the number of main scan lines Lr of the remaining area WR, from the main scan line immediately below to nozzle #6 to the main scan line of the lower end of the blank area, is greater than the number of nozzles N in the nozzle row. In the state subsequent to the fourth pass, the remaining area within the second blank area Rb2 is the seven lines from the 25th to the 31st line. This area is labeled WR2 in FIG. 1. The number of main scan lines Lr in the remaining area WR2 is seven lines, and since this is larger than the six nozzles, the result of the determination of Step S12 is "Yes." Furthermore, for comparison sake, the main scan line width H of six dots, within which nozzles are provided in the sub-scan direction, is indicated in FIG. 1 by an arrow, which starts at the 25th line.

When the result of the determination of Step S12 is "Yes," a positioning sub-scan feed is performed in Step S14. This positioning sub-scan feed is performed such that upper end nozzle #1 is positioned over the 32nd line, which is the main scan line of the upper end of the third dot recording area Rr3. The feed amount SSp1 of this positioning sub-scan feed is equivalent to the sum of the inter-band sub-scan feed amount SSb1 and the width Lr of the remaining area WR. That is, feed amount SSp1 is (SSb1+Lr)×D. In the first embodiment, since SSb1 is six dots, and Lr subsequent to the fourth pass is seven dots, the feed amount SSp1 of the positioning sub-scan feed, as shown in FIG. 1, is 13 dots. A Step S14 positioning sub-scan feed such as this is executed by positioning sub-scan feed unit 41*b* of CPU 41 (refer to FIG. 3).

Thereafter, a unit scan operation is once again carried out in Step S2. This unit scan operation is the fifth pass in FIG. 1. In the fifth pass, the 32nd through the 37th lines are recorded. Hereinafter, dots are similarly formed in each dot recording area of the printing paper by Steps S2 through S14. When dots have been formed in all main scan lines in the dot recording area on this printing paper, the result of the determination of Step S8 becomes "Yes," and processing ends.

In the first embodiment, when the width Lr of the remaining area WR is greater than the number of nozzles N, a positioning sub-scan feed is performed. That is, a positioning sub-scan feed is carried out when the feed amount of a positioning sub-scan feed is greater than the feed amount of a second inter-band sub-scan (SSb1×2). Therefore, the number of sub-scans can reliably be reduced, and the time required for printing can be shortened.

Furthermore, in the flowchart of FIG. 5, it is also possible to perform a positioning sub-scan feed in Step S14 all time when the result of the determination of Step S10 was "Yes," without the determination in Step S12. Even in a mode such as this, it is possible to carry out a positioning sub-scan feed with a larger feed amount than an inter-band sub-scan. If such a positioning sub-scan feed with a larger feed amount than an inter-band sub-scan is performed a plurality of times for a single piece of printing paper, it would be possible to reduce the number of sub-scans required for overall printing. In such cases, it will be possible to shorten the time required for printing.

B. Second Embodiment:

In the second embodiment, printing is performed with a smaller main scan line pitch by a printer having the same hardware constitution as the printer in the first embodiment. In this embodiment, the main scan line pitch is ¼ the nozzle pitch.

Figure 6:
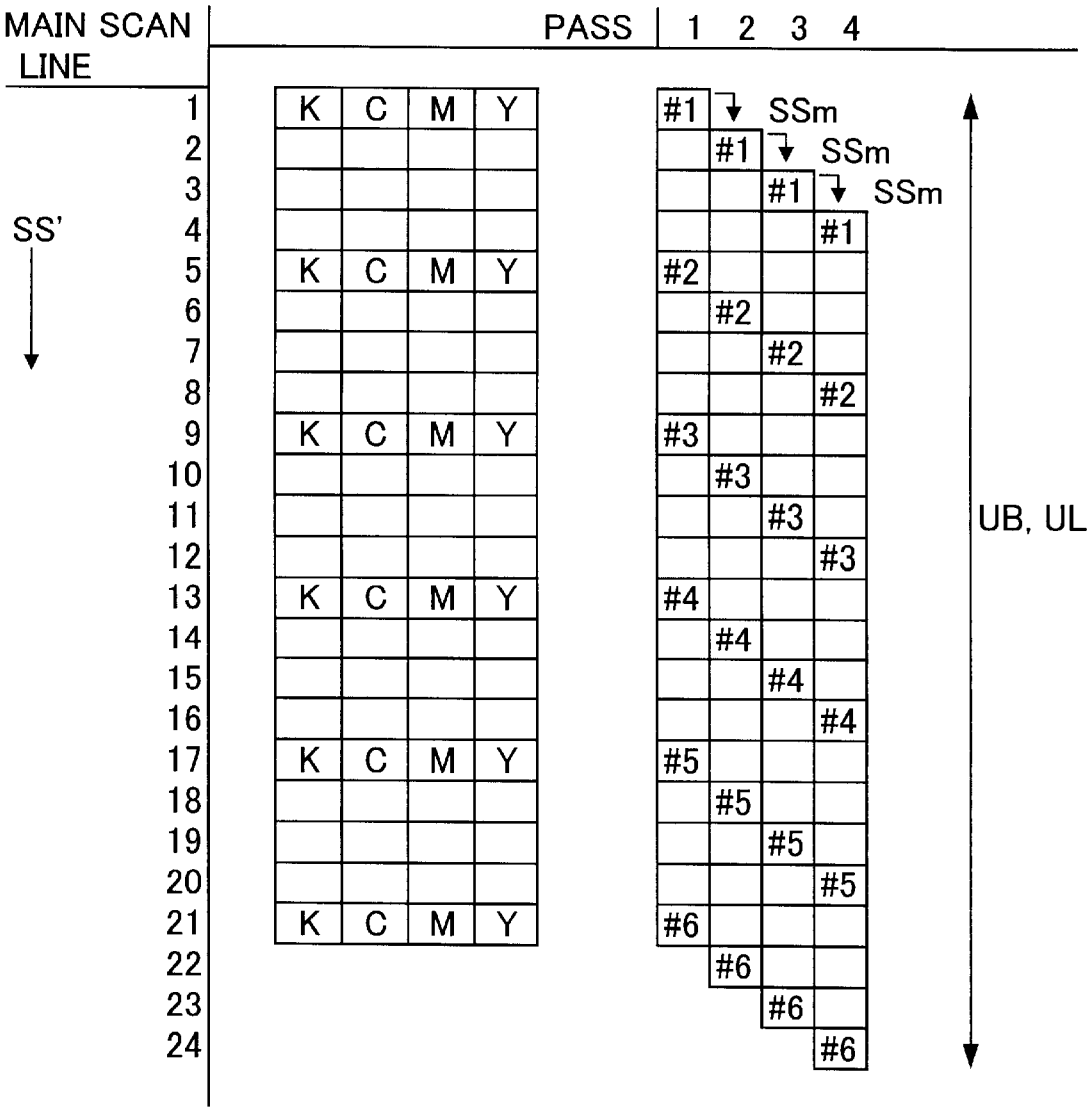
FIG. 6 is a schematic diagram showing the recording of main scan lines via unit scan operations of the second embodiment.

FIG. 6 is a schematic diagram showing the recording of main scan lines by unit scan operations of the second embodiment. The nozzle arrangement is schematically portrayed in the left side of FIG. 6, and the manner in which the main scan lines are recorded by the respective nozzles is shown in the right side. Furthermore, in order to simplify the explanation, only one row of nozzles is depicted in the right side of FIG. 6. The numbers with pound signs (#) inside the squares are the numbers of the nozzles, which record each main scan line.

In FIG. 6, each main scan line is a row of pixels extending in the crosswise direction, respectively. The pitch of main scan lines that are adjacent to one another in the vertical direction is D. As is clear from FIG. 6, in the second embodiment, the spacing from one nozzle to the next nozzle in the sub-scan direction is equivalent to four main scan lines. That is, the pitch in the vertical direction (sub-scan direction) of each nozzle on the print head is 4×D. Therefore, the pitch of each nozzle on the print head is four dots.

In printing in the second embodiment, a unit scan operation comprises four main scans, which are implemented by performing sub-scans of one dot each at the intervals therebetween as shown in FIG. 6. That is, in the second embodiment, a single "unit scan operation" is completed by carrying out a total of three sub-scan feeds of a feed amount SSm of one dot, and performing four main scans. According to this unit scan operation, dots are recorded in a band, which constitutes a plurality of main scan lines, which are adjacent to one another in the sub-scan direction. Furthermore, a sub-scan carried out between main scans in a unit scan operation is called a "micro-feed." In printing in the second embodiment, at the interval between a unit scan operation and a unit scan operation, an inter-band sub-scan with a feed amount that is larger than a micro-feed is carried out, and recording is performed in order on a printing paper in units of main scan line bundles. Furthermore, the number of main scans in a unit scan operation is the equivalent of the nozzle pitch.

As shown in FIG. 6, the number of main scan lines L1, which are the main scan lines recorded when a unit scan operation is performed, and which are lined up without gaps in the sub-scan direction, is 24. Furthermore, an aggregate of main scan lines recorded when a unit scan operation is performed is called a "unit line." Of these, a bundle of main scan lines lined up without gaps in the sub-scan direction is called a "unit band." The number of main scan lines in a unit line NK can be determined by N×k. N is the number of nozzles in a row of nozzles, and k is the number of main scans k in a unit scan operation. In the second embodiment, in order for all the main scan lines recorded by a unit scan operation to line up without spaces in the sub-scan direction, a "unit line" coincides with a "unit band." In FIG. 6, the unit band and unit line areas are indicated by UB and UL. In the second embodiment, once one unit scan operation is finished, an inter-band sub-scan of 24 main scan lines is carried out in order to perform the next unit scan operation. The feed amount SSb2 of the inter-band sub-scan is 24 dots.

Figure 7:
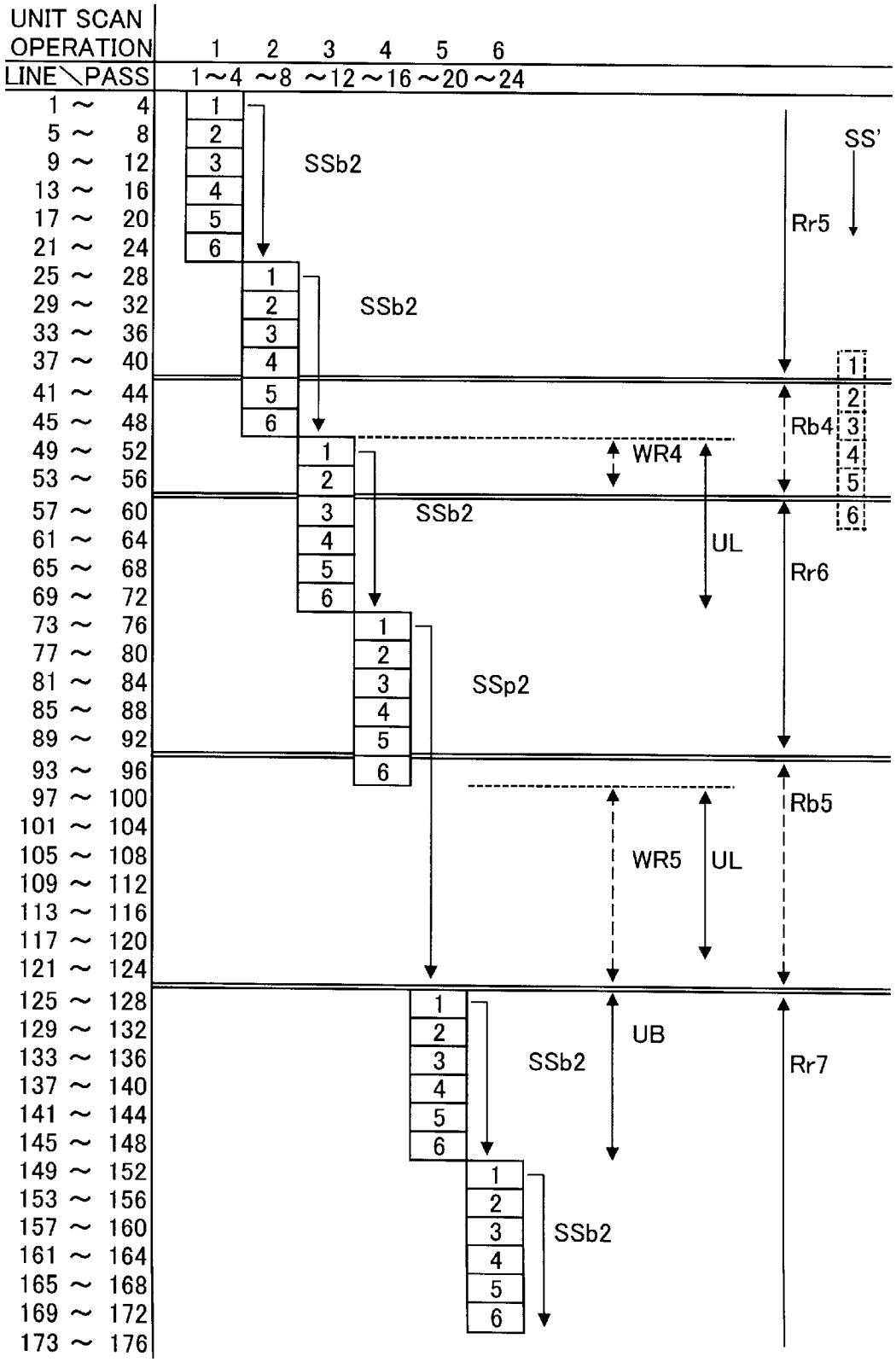
FIG. 7 is a schematic diagram showing how image data is recorded in the second embodiment.

FIG. 7 is a schematic diagram showing how image data is recorded in the second embodiment. In FIG. 7, the four main scan lines recorded by one nozzle during a single unit scan operation are schematically represented as a row of squares lined up in the horizontal direction. For example, the uppermost row represents the first through the fourth lines recorded by nozzle #1 during the initial unit scan operation.

In the second embodiment, a first dot recording area Rr5 in which dots are to be formed, a first blank area Rb4 in which dots are not formed, a second dot recording area Rr6 in which dots are to be formed, a second blank area Rb5 in which dots are not formed, and a third dot recording area Rr7 in which dots are to be formed exist in order in the sub-scan direction correspondent to the image data to be printed.

Further, in FIG. 7, the print head, which executes unit scan operations, is schematically represented by six squares lined up vertically. That is, an area equivalent to the width of the four main scan lines, which each nozzle records during a single unit scan operation, is represented by a single square. Further, the width of the six squares lined up vertically is equivalent to the width of a unit line.

Figure 8:
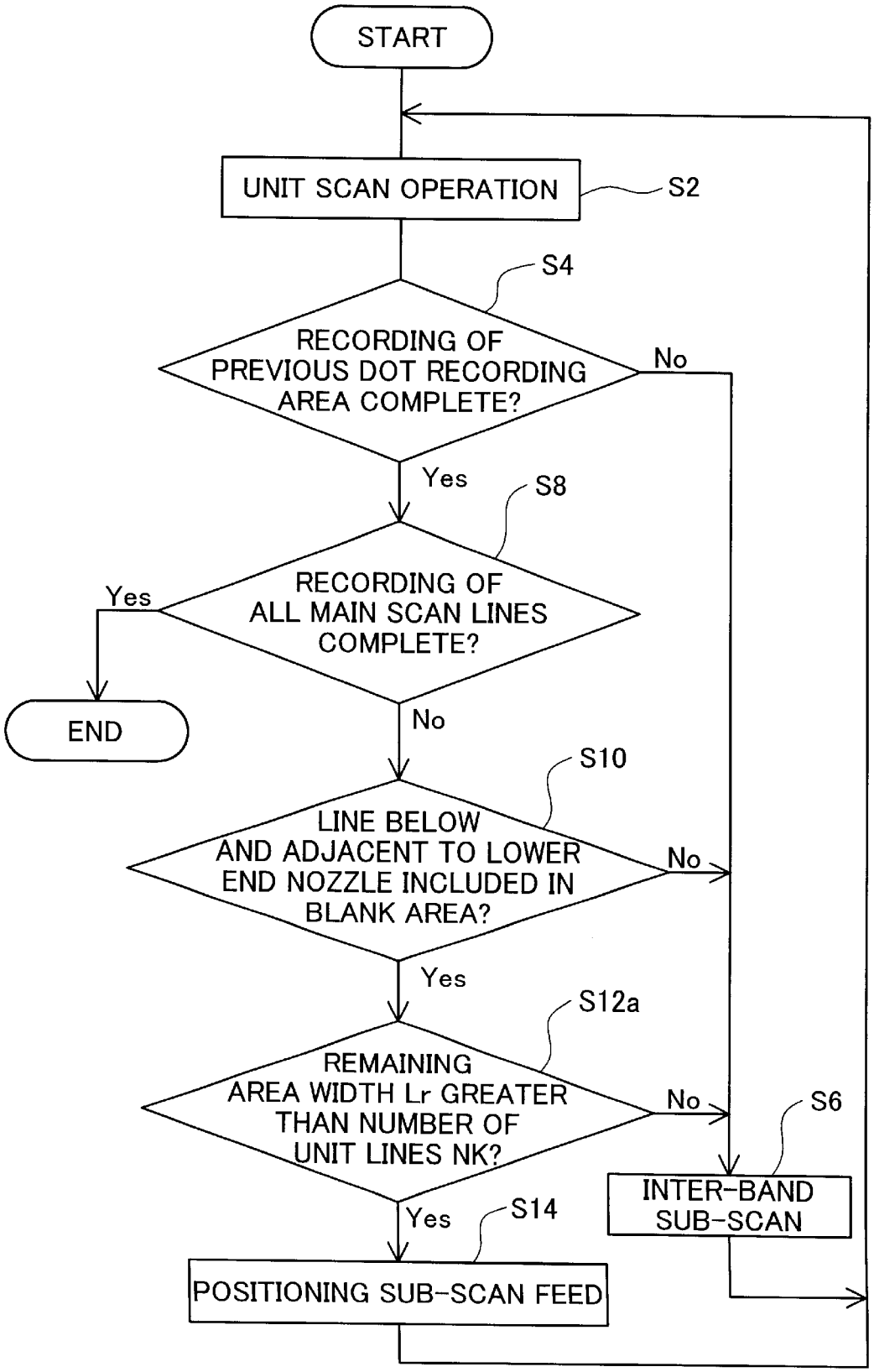
FIG. 8 is a flowchart showing the printing procedure in the second embodiment.

FIG. 8 is a flowchart showing the printing procedure for the second embodiment. In FIG. 8, the number of the unit scan operation is listed above the pass number at the top. Even when printing, which is accompanied by micro-feeds as shown in FIG. 6, is carried out, printing can be performed via practically the same procedure as the procedure for the first embodiment shown in FIG. 5. However, the unit scan operation in Step S2 comprises a plurality of main scans accompanied by micro-feeds of one dot each as shown in FIG. 6. Then, dots are recorded in 24 main scan lines by one unit scan operation. Further, in the second embodiment, instead of the determination made in Step S12 of FIG. 5, a determination is made in Step S12*a* as to whether or not the number of main scan lines Lr of the remaining area WR is greater than the number of unit lines NK, that is, whether or not it is larger than N×k lines (where N is the number of nozzles in a nozzle row, and k is the nozzle pitch). The other procedures are the same as the printing of the first embodiment.

In the second embodiment, in a state, wherein the eighth pass has been completed, since all main scan lines of the first dot recording area have been recorded, the result of the determination of Step S4 of FIG. 8 is "Yes." Further, in the state, wherein the eighth pass has ended, since the recording of the second dot recording area Rr6 and third dot recording area Rr7 have not yet to be completed, the result of the determination of Step S8 is "No." In addition, in the state, wherein the eighth pass has ended, nozzle #6, which is positioned at the lower end of the nozzle row, is positioned at the 48th line. Then, the 49th line, which is below and adjacent thereto, is included in the first blank area Rb4. Accordingly, the result of the determination of Step S10 is "Yes."

Furthermore, as shown by the broken line at the far right of FIG. 7, when the main scan line (61st line) positioned below and adjacent to the main scan line (60th line) at which nozzle #6 is positioned is in a dot recording area, the result of the determination of Step S10 becomes "No." In that case, once again an inter-band sub-scan of feed amount SSb2 is executed in Step S6, and a unit scan operation is performed in Step S2.

When the result of the determination of Step S10 is "Yes," the determination of Step S12*a* is carried out next. In Step S12*a,* a determination is made as to whether or not the number of main scan lines Lr of the remaining area WR is greater than the number of unit lines NK=N×k. Furthermore, N is the number of nozzles, and k is the number main scans comprising a unit scan operation. This k is equivalent to the nozzle pitch.

In a state, wherein the eighth pass has ended, the main scan line immediately below to nozzle #6 is the 49th line, and the main scan line of the lower end of the first blank area Rb4 is the 56th line. Therefore, the number of main scan lines Lr of the remaining area WR is eight lines. This area is labeled WR4 in FIG. 7. Meanwhile, the number of unit lines NK is the six nozzles times four main scans, or 24 lines. Accordingly, the result of the determination of FIG. 12*a* is "No." Furthermore, for the sake of comparison, the width of the unit line is indicated by arrow UL beginning at the 49th line in FIG. 1. When the result of the determination of Step S12*a* constitutes "No," once again an inter-band sub-scan of feed amount SSb2 is executed in Step S6, and a unit scan operation is performed in Step S2.

Thereafter, the 9th pass through the 20th pass are executed in accordance with the procedures of Steps S2 through S6. In the third unit scan operation comprising the ninth through the 20th passes, the 57th through the 72nd lines are recorded as shown in FIG. 7. Further, in the fourth unit scan operations comprising the 13th through the 16th passes, the 73rd through the 92nd lines are recorded.

In a state, wherein the fourth unit scan operation has ended, that is, a state, wherein the 16th pass has ended, since the recording of the second dot recording area Rr6 is complete, the result of the determination of Step S4 is "Yes." Then, the result of the determination in Step S8, which is carried out thereafter, becomes "No" because the recording of the third dot recording area Rr7 is not complete.

In the state subsequent to the fourth unit scan operation, the line below and adjacent to nozzle #6 is the 97th line. Since the 97th line is included in the second blank area Rb5, the result of the determination of Step S10 becomes "Yes." Then, in the state subsequent to the fourth unit scan operation, the remaining area, which is the area positioned below nozzle #6 within the second blank area Rb5, is the 28 lines from the 97th through the 124th lines. This area is labeled WR5 in FIG. 7. Since the number of main scan lines Lr of the remaining area WR5 is 28 lines, and this is greater than the number of unit lines NK=24 lines, the result of the determination of Step S12*a* constitutes "Yes." Furthermore, for the sake of comparison, the width of the unit line is indicated in FIG. 7 by arrow UL, which begins at the 49th line.

When the result of the determination of Step S12*a* is "Yes," a positioning sub-scan feed is performed in Step S14. The positioning sub-scan feed is performed such that the main scan line of the upper end within a unit band constitutes a relative position, which coincides with the 125th line, which is the main scan line of the upper end of the third dot recording area Rr7. As for the positioning sub-scan feed in FIG. 7, nozzle #1 is sent from a state, wherein it is position at the 76th line, to a state, wherein it is positioned at the 125th line. Furthermore, the scope of the unit band of a post-positioning sub-scan feed fifth unit scan operation is indicated by UB.

The feed amount of this positioning sub-scan feed is equivalent to the sum of the feed amount SSb of an inter-band sub-scan and the width Lr of the remaining area WR. In the second embodiment, the feed amount SSb2 of the inter-band sub-scan is 24 dots, and since the number of main scan lines Lr of the remaining area WR5 subsequent to the fourth unit scan operation is 28 dots, the feed amount Lp of the positioning sub-scan feed SSp2 is 53 dots as shown in FIG. 7.

Thereafter, a unit scan operation is once again performed in Step S2. This unit scan operation is the fifth unit scan operation, beginning at the 17th pass in FIG. 7. In the fifth unit scan operation, the 125th through the 148th lines are recorded. Hereinafter, dots are formed in the same manner in each dot recording area of the printing paper by Steps S2 through S14. When dots have been formed in all main scan lines in the dot recording areas on this printing paper, the result of the determination of Step S8 becomes "Yes," and processing ends.

In the second embodiment, a positioning sub-scan feed is performed when the width of the remaining area is greater than the number of unit lines. Thus, the number of sub-scans can be reduced, and the time required for printing can be shortened.

Figure 9:
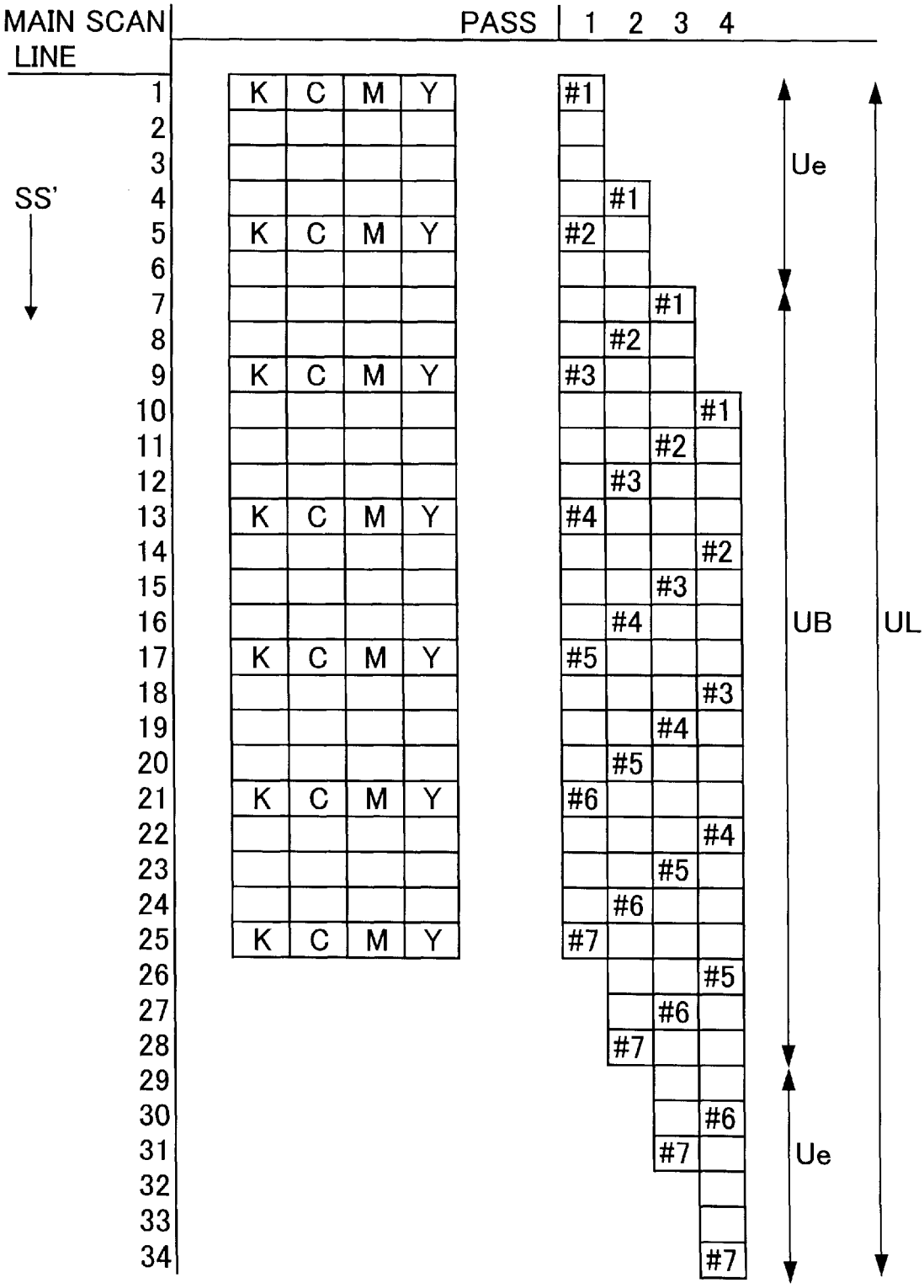
FIG. 9 is a schematic diagram showing the recording of main scan lines via unit scan operations of a third embodiment.

C. Third Embodiment:

FIG. 9 is a schematic diagram showing the recording of main scan lines via unit scan operations of a third embodiment. In the third embodiment, each nozzle row on the print head has seven nozzles set at a four-dot pitch. Then, in the printing of the third embodiment, a micro-feed of a feed amount SSm2 of three dots is performed in a unit scan operation. Inter-band sub-scans SSb3 of a feed amount SSb3 of 19 dots are performed between unit scan operations. The other points are the same as the second embodiment.

In the third embodiment, whereas the unit band is the 22 main scan lines of the 7th line through the 28th line, which are lined up without gaps in the sub-scan direction in FIG. 9, the unit line is 28 main scan lines, comprising the first line through the 34th line. The scope of a unit band UB and the scope of a unit line UL are shown in the right side of FIG. 9. At both ends of the scope UL, within which the unit line is disposed, there are scopes Ue, within which main scan lines in which dots cannot be recorded are intermingled with main scan lines in which dots can be recorded.

Figure 10:
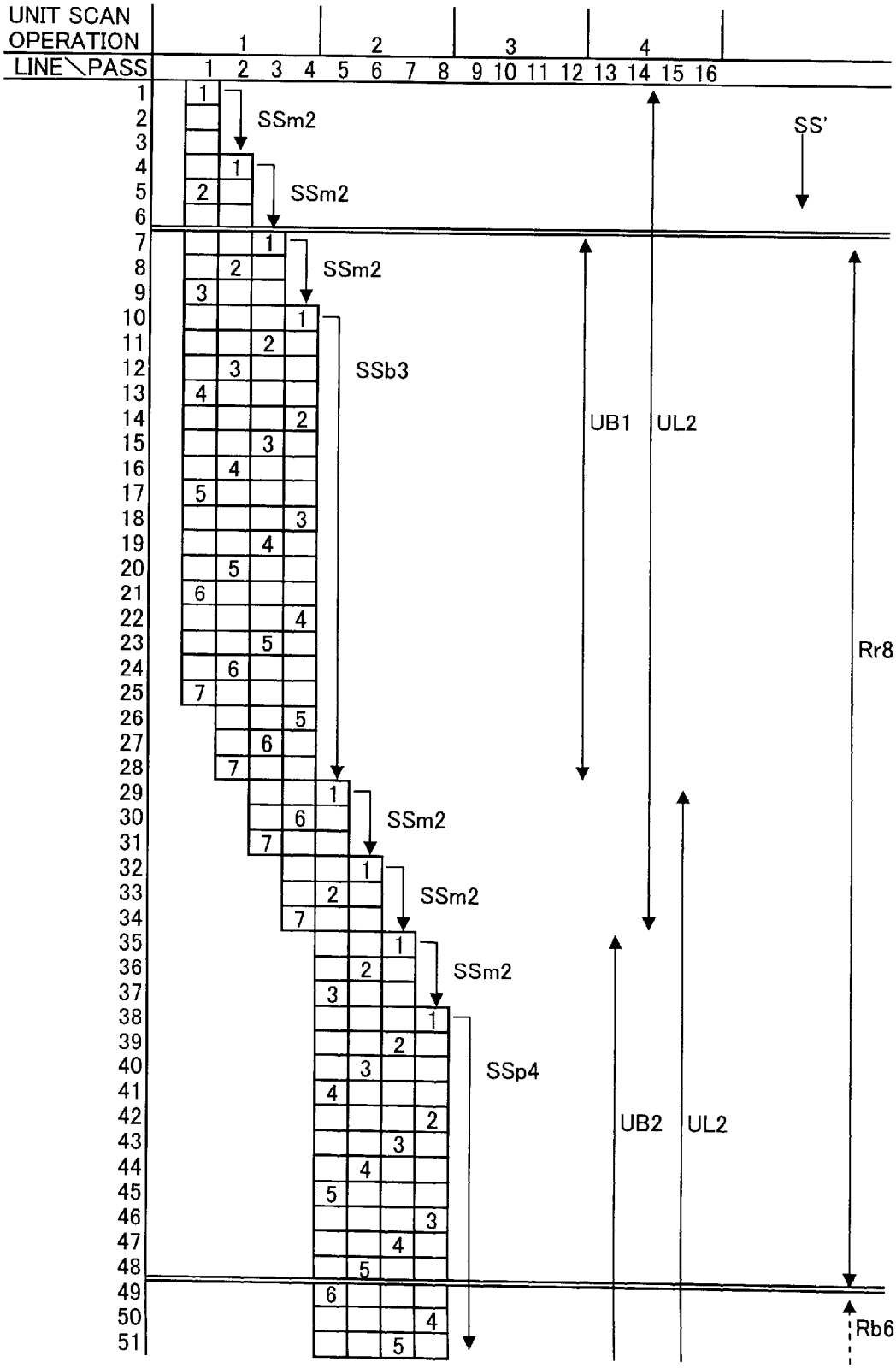
FIG. 10 is a schematic diagram showing how image data, comprising dot recording areas and blank areas, is recorded in the third embodiment.
Figure 11:
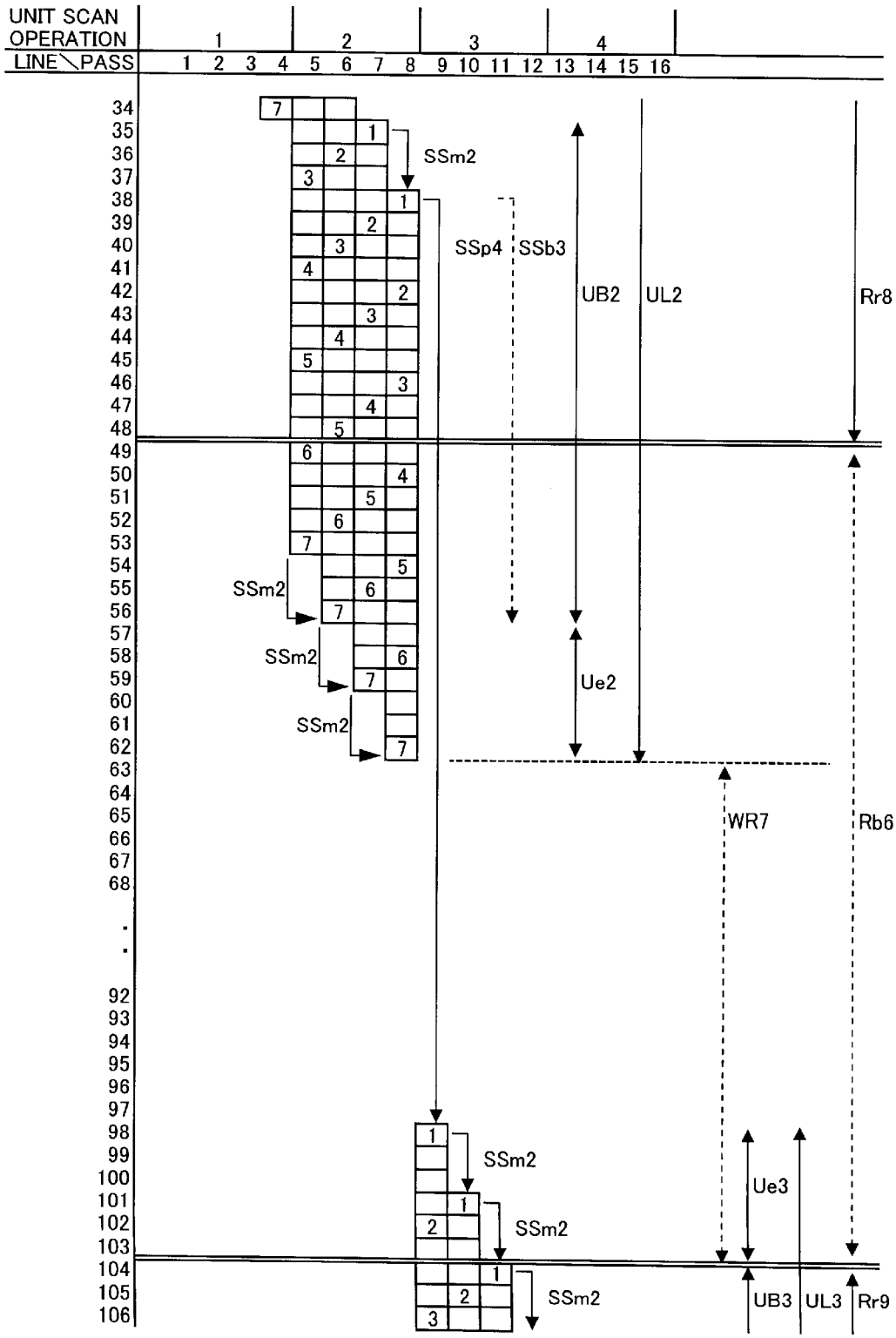
FIG. 11 is a schematic diagram showing how image data, comprising dot recording areas and blank areas, is recorded in the third embodiment.
Figure 12:
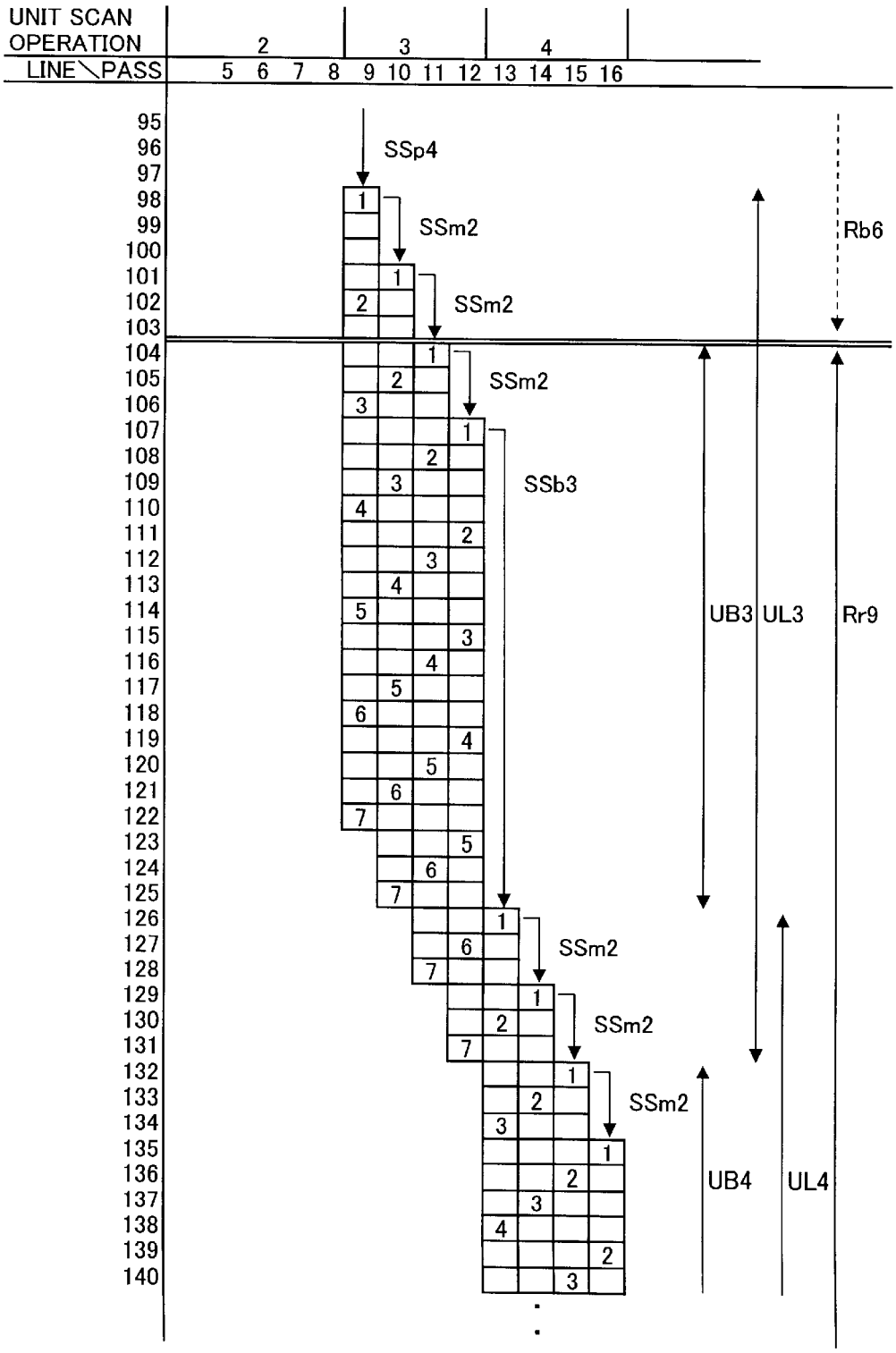
FIG. 12 is a schematic diagram showing how image data, comprising dot recording areas and blank areas, is recorded in the third embodiment.

FIG. 10 through FIG. 12 are schematic diagrams showing how image data, comprising dot recording areas and blank areas, is recorded in the third embodiment. A first dot recording area Rr8 in which dots are to be recorded, a first blank area Rb6 in which dots are not recorded, and a second dot recording area Rr9 in which dots are to be recorded exist in order in the sub-scan direction on the printing paper of the third embodiment. Furthermore, in FIG. 10 through FIG. 12, a portion of the main scan lines is disclosed in two figures. Further, in FIG. 11, the disclosure of the 69th line through the 91st line has been omitted.

Printing in the third embodiment is performed via the same procedures as the second embodiment. That is, dots are recorded in the fifth dot recording area Rr8 using the procedures of Step S2 through S6 of FIG. 8. However, the unit scan operation in Step S2 comprises a plurality of main scans accompanied by micro-feeds, which are feed amounts SSm2 of three dots as shown in FIG. 9. Then, dots are recorded on 28 main scan lines via a single unit scan operation.

The recording of the first dot recording area Rr8 is completed by a first and second unit scan operation. Furthermore, the scope of the unit band of each unit scan operation is indicated by UB1 through UB4 in FIG. 10 through FIG. 12. Then, the scope of the unit line of each unit scan operation is indicated by UL1 through UL4. As shown in FIG. 10 and FIG. 11, when the eighth pass, which is the last pass on the second unit scan operation, is finished, since the recording of the first dot recording area Rr8 is complete, the result of the determination of Step S4 of FIG. 8 constitutes "Yes." Then, the result of the determination in Step S8 becomes "No" because the recording of the second dot recording area Rr9 is not complete.

As shown in FIG. 11, in the state following the second unit scan operation, the line below and adjacent to lower end nozzle #7 is the 63rd line. Since the 63rd line comprises blank area Rb6, the result of the determination of Step S10 of FIG. 8 is "Yes." Then, in the state following the second unit scan operation, the remaining area, which is the area positioned below nozzle #7 within blank area Rb6, is the 41 lines from the 63rd through the 103rd lines. This area is labeled WR7 in FIG. 11. Since the number of main scan lines of the remaining area WR7 is greater than the number of unit lines NK=28 lines in this embodiment, the result of the determination of Step S12*a* becomes "Yes."

When the result of the determination of Step S12*a* is "Yes," a positioning sub-scan feed is performed in Step S14. In FIG. 11, a positioning sub-scan feed of a feed amount of 60 dots, from a state, wherein nozzle #1 is positioned on the 38th line, to a state, wherein it is positioned on the 98th line, is carried out. The feed amount of this positioning sub-scan feed is equivalent to the sum of the inter-band sub-scan feed amount SSb3 and the width Lr of the remaining area WR. In the third embodiment, the inter-band sub-scan feed amount SSb3 is 19 dots, and the width Lr of the remaining area WR7 subsequent to the second unit scan operation is 41 dots. Therefore, the feed amount SSp4 of the positioning sub-scan feed is 19 dots+41 dots, or 60 dots.

The feed amount of the positioning sub-scan feed can also be explained using FIG. 11. That is, as indicated by the broken line in FIG. 11, when it is supposed that inter-band sub-scan SSb3 will be performed after the second unit scan operation (after the eighth pass), nozzle #1 is sent from the 38th line to the 57th line. In case of the positioning sub-scan feed, nozzle #1 is sent to the relatively downer position. The feed amount difference from the position in case of inter-band sub-can to the position in case of the positioning sub-scan feed is equivalent to the sum of the width Lr of remaining area WR7 and the width of area Ue2 minus the width of area Ue3. Area Ue2 is included in the scope of unit line UL2 of the second unit scan operation, and is the area of lower end among the areas not included in the scope of unit band UB2. Area Ue3 is included in the scope of unit line UL3 of the third unit scan operation, and is the area of upper end among the areas not included in the scope of unit band UB3 (refer to FIG. 9). As is clear from FIG. 9, because the widths of area Ue2 and area Ue3 are equivalent, the feed amount of positioning sub-scan feed SSp4, in the end, is equivalent to a distance, which adds the width Lr of the remaining area WR to the feed amount SSb3 of an inter-band sub-scan.

After the positioning sub-scan feed SSp4 has been executed in Step S14 of FIG. 8, a unit scan operation is once again carried out in Step S2. This unit scan operation is the third unit scan operation, which starts from the ninth pass in FIG. 12. In the third unit scan operation, main scan lines comprising the 104th through the 131st lines are recorded. Hereinafter, dots are formed in the same manner in each dot recording area of the printing paper by Steps S2 through S14. When dots have been recorded in all main scan lines in the dot recording areas, the result of the determination in Step S8 becomes "Yes," and processing ends.

In the third embodiment, printing is performed by using N (where N is an integer of 2 or greater) nozzles, which are arranged at a nozzle pitch k×D (where k is an integer of 2 or greater and D is the main scan line pitch,) and by performing a unit scan operation, which is constituted by k main scans and (k−1) sub-scans according to a predetermined first feed amount (three dots), while executing inter-band sub-scans using a predetermined second feed amount (19 dots) between each unit scan operation. It is possible to carry out a positioning sub-scan feed in the printing of an image comprising blank areas as the third embodiment. Thus, by carrying out a positioning sub-scan feed, it is possible to reduce the number of sub-scans and shorten the time required for printing.

Figure 13:
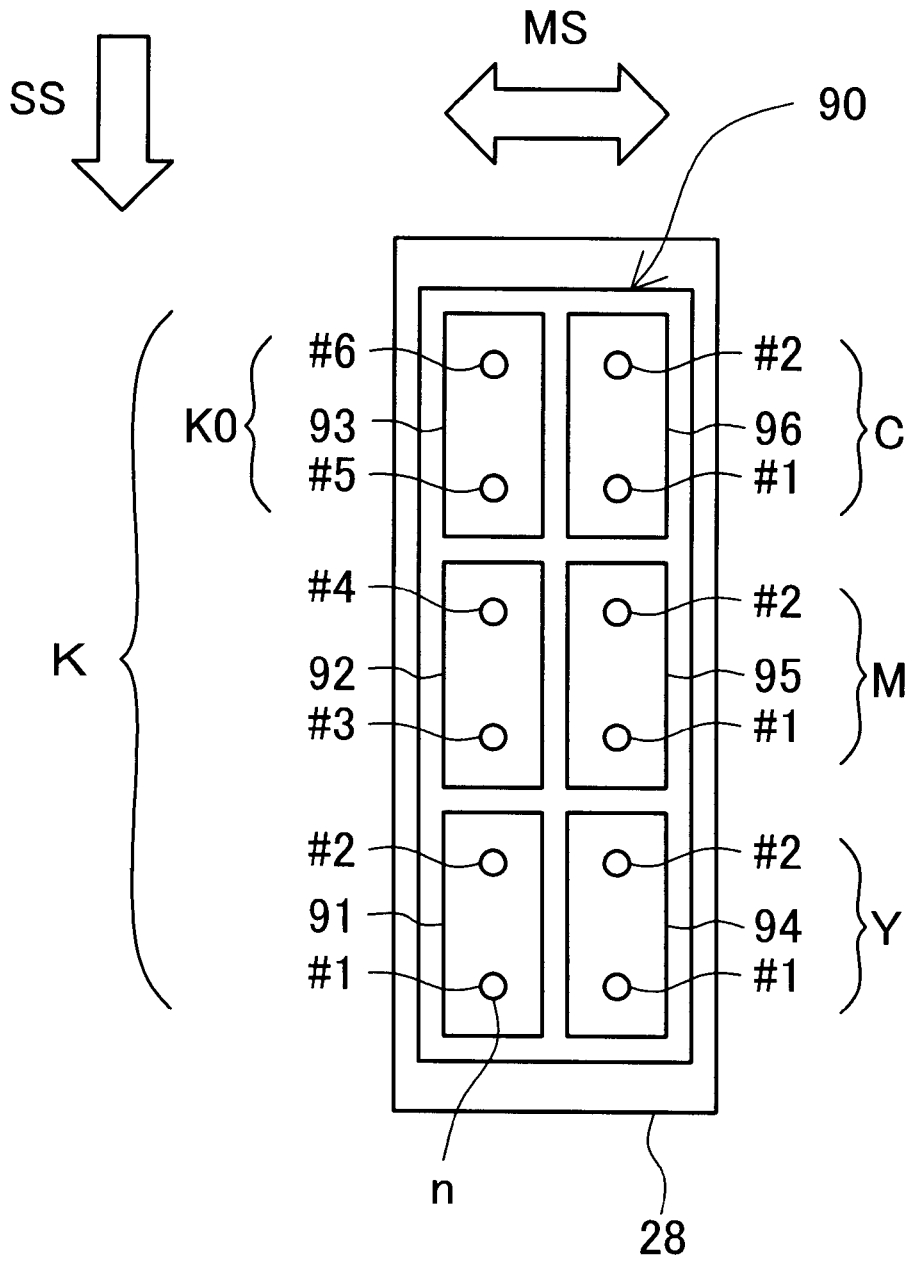
FIG. 13 is a schematic diagram showing the arrangement of nozzles disposed in the print head 28 of a fourth embodiment.

D. Fourth Embodiment:

FIG. 13 is a schematic diagram showing the arrangement of nozzles disposed in the print head 28 of a fourth embodiment. The printer of the fourth embodiment is a printing apparatus for printing using four colors of ink: black (K), cyan (C), magenta (M) and yellow (Y). This printer comprises two nozzles each for cyan (C), magenta (M) and yellow (Y), and comprises six nozzles for black (K). Hereinbelow, nozzles #1, #2 for cyan (C), magenta (M) and yellow (Y) will be called the single chromatic nozzle group, and nozzles #1 through #6 for black (K) will be called the achromatic nozzle groups. Further, black (K) nozzles #5, #6 will be called the specified achromatic nozzle group. The hardware constitution other than the nozzles is the same as the printer 20 of the first embodiment.

Figure 14:
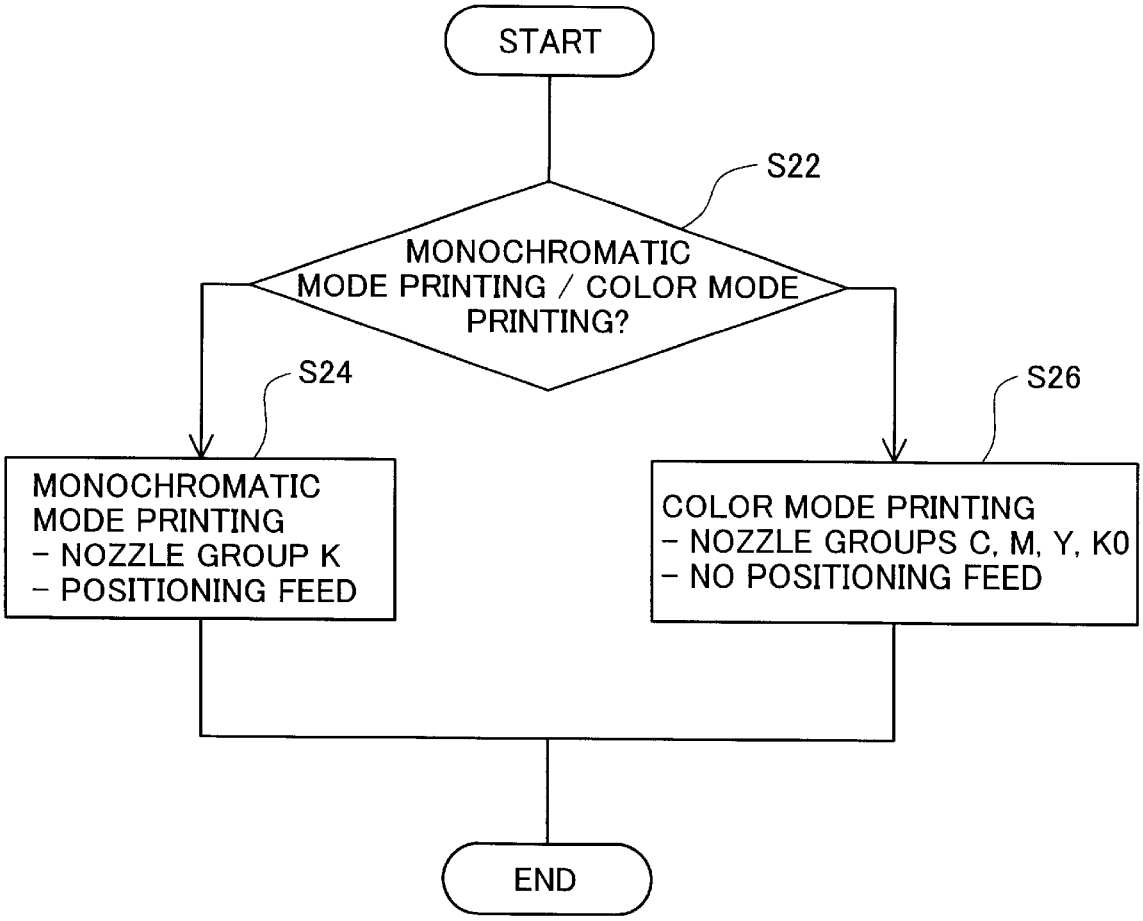
FIG. 14 is a flowchart showing the printing procedure of the fourth embodiment.

FIG. 14 is a flowchart showing the printing procedure of the fourth embodiment. The printer of the fourth embodiment is capable of executing color mode printing for performing color printing using the single chromatic nozzle groups and the specified achromatic nozzle group, and monochromatic mode printing performed using the achromatic nozzle group. At printing, the decision as to whether color mode printing, or monochromatic mode printing will be implemented is determined by print signals PS supplied from computer 88.

At printing time, first, a determination is made in Step S22 on the basis of the information in print signals PS as to whether color mode printing or monochromatic mode printing will be executed. When monochromatic mode printing is executed, printing is performed in Step S24 using the achromatic nozzle group, that is, nozzle group K. In monochromatic mode printing, printing is performed in accordance with the flowchart of FIG. 5 via the same procedures as the first embodiment. That is, an inter-band sub-scan of a feed amount of 6 dots is performed in a dot recording area, and a positioning sub-scan feed is performed without executing an inter-band sub-scan in the remaining area, the width of which is wider than the width in which nozzle group K is disposed (Refer to Steps S10, S12, and S14 of FIG. 5, and FIG. 1.).

Conversely, when executing color mode printing, printing is performed in Step S26 of FIG. 14 using the single chromatic nozzle groups and the specified achromatic nozzle group, that is, nozzle groups C, M, Y and K0. Then, in color mode printing, inter-band sub-scans of two dots each are performed between main scans which are executed while drops of ink are being ejected. Further, positioning sub-scan feeds are not performed even in the blank areas. Furthermore, in both color mode printing and monochromatic mode printing, the main scan line pitch and the nozzle pitch are equivalent to one another.

Using a mode such as the fourth embodiment, whereas two main scan lines can be recorded by a single main scan in color mode printing, six main scan lines can be recorded by a single main scan in monochromatic mode printing. Accordingly, monochromatic mode printing can be executed at higher speed than color mode printing. Further, since a positioning sub-scan feed is performed in monochromatic mode printing, printing can be performed in a shorter period of time in monochromatic mode printing.

E. Fifth Embodiment:

The constitution of the printer 20 of a fifth embodiment is the same as the printer of the fourth embodiment. However, in the fifth embodiment, printing is performed at a dot recording density, whereby the main scan line pitch is ¼ the nozzle pitch shown in FIG. 13. That is, in the fifth embodiment, the nozzle pitch is four times the main scan line pitch. Thus, in the fifth embodiment, positioning sub-scan feeds are performed even during color mode printing.

Figure 15:
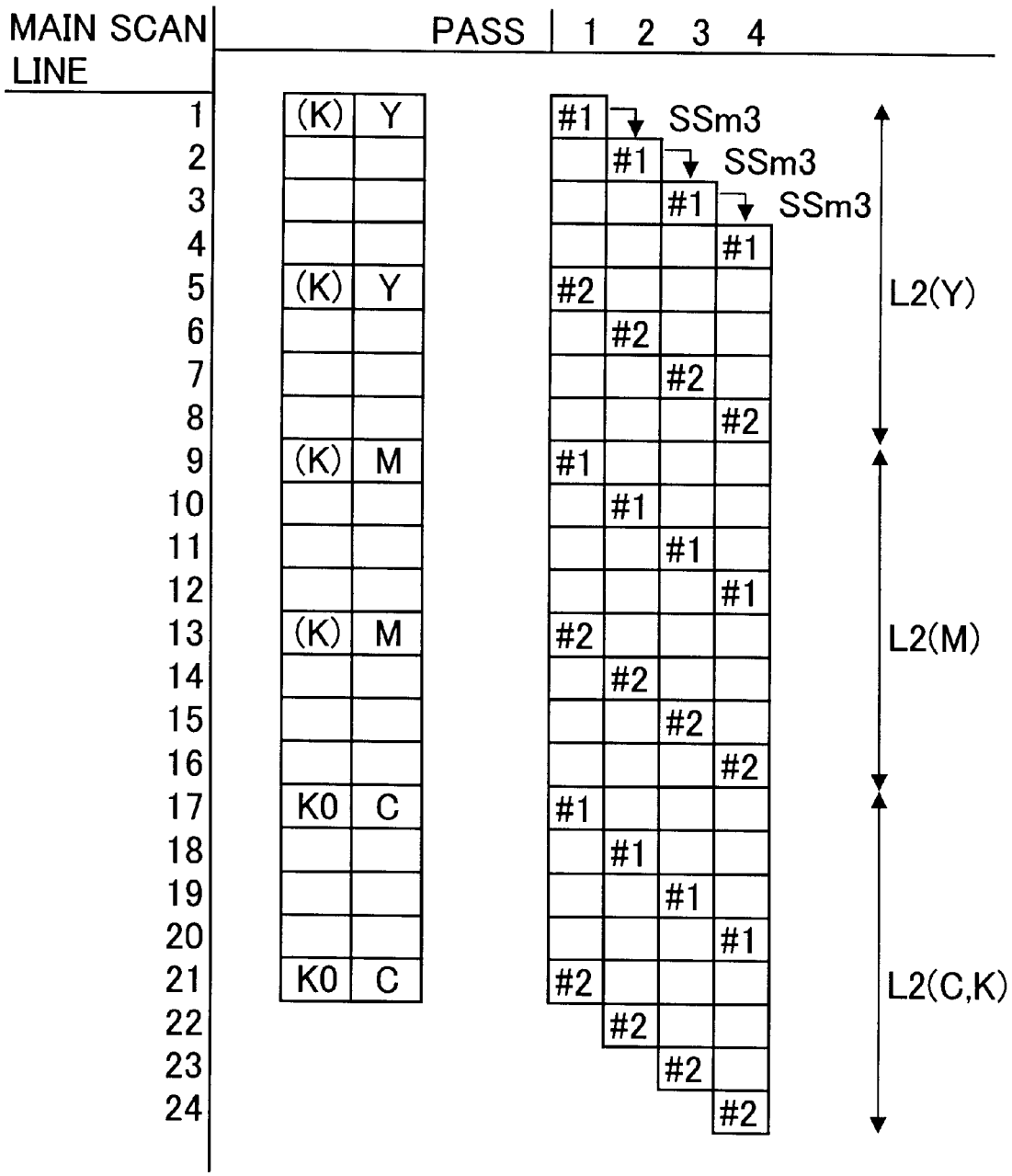
FIG. 15 is a schematic diagram showing the recording of main scan lines via unit scan operations during color mode printing in a fifth embodiment.

FIG. 15 is a schematic diagram showing the recording of main scan lines by unit scan operations during color mode printing in the fifth embodiment. In printing in the fifth embodiment, a unit scan operation is performed in which main scans are performed k times with micro-feeds (sub-scans) of a feed amount of one dot each between main scans. This unit scan operation records dots inside a band, which constitutes a plurality of main scan lines adjacent to one another in the sub-scan direction. Then a large feed is performed at the interval between a unit scan operation and a unit scan operation, and recording is carried out on printing paper in order in units of main scan line bundles. In the fifth embodiment, as shown in FIG. 15, a single unit scan operation is completed by repeating three one-dot feeds, and executing main scans four times. Furthermore, a single main scan is called a "pass."

In color mode printing in the fifth embodiment, printing is performed by using the same number of nozzles for each ink color. For this reason, only two nozzles, nozzles #5, #6, are used as the nozzles of the black nozzle group K (refer to FIG. 13). The black nozzles used in color mode printing are called the "specified black nozzle group K0."

As shown in FIG. 15, when a unit scan operation is carried out using the single chromatic nozzle groups Y, M, C, and the specified black nozzle group KO, the number of main scan lines recorded by the ink ejected by each of these nozzle groups (called a "single chromatic unit band) is eight, respectively. The same holds true for the specified black nozzle group KO as well. In color mode printing, after one unit scan operation has been completed, a sub-scan amounting to five main scan lines is executed before the next unit scan operation is performed. This sub-scan is called a "color mode inter-band sub-scan." The feed amount SSb4 of a color mode inter-band sub-scan is five dots.

Focusing the explanation on the 17th through the 24th lines of FIG. 15, first, dots are formed in the 17th through the 24th lines by nozzles #5, #6 of the specified black nozzle group and the cyan nozzle group C via an initial unit scan operation. Thereafter, when a five-dot color mode inter-band sub-scan is carried out, this time magenta dots are recorded in the 17th through the 24th lines by the magenta nozzle group M. When another five-dot color mode inter-band sub-scan is carried out, yellow dots are recorded in the 17th through the 24th lines by the yellow nozzle group Y. In this manner, dots of each of the colors black, cyan, magenta and yellow are formed in the 17th through the 24th lines, and a color image is recorded. Similarly, recording is carried out in order by three unit scan operations for each main scan line on the printing paper.

Furthermore, to simplify the explanation for FIG. 15, the recording of each main scan line by nozzles #5, #6 of the specified black nozzle group is not shown. The recording of the respective main scan lines by these black nozzles #5, #6 is performed in the same manner as the recording of each main scan line by cyan nozzles #1, #2.

Cases when unit scan operations are performed using the single chromatic nozzle groups Y, M, C, and the specified black nozzle group K0, and color mode inter-band sub-scans are executed between the respective unit scan operations, that is, cases of color mode printing, will be explained. In color mode printing, the main scan line, at which the yellow nozzle group Y finished recording in each unit scan operation, is the main scan line, where the printing of printing data for all the inks KCMY is completed. Recording of main scan lines based on printing data is newly completed for eight lines by each unit scan operation. The aggregate of main scan lines, for which a plurality of single chromatic nozzle groups and achromatic nozzle group can complete recording anew during a single unit scan operation such as this, is called a "color unit line." And the main scan lines of a color unit line that are lined up without gaps in the sub-scan direction are called a "color unit band." This "color unit band" is equivalent to the "unit band" referred to in the Claims. In the fifth embodiment, a "color unit line" coincides with a "color unit band." The width of a color unit band is equivalent to the width of a single chromatic unit band. A color unit band ordinarily coincides with the single chromatic unit band of the uppermost single chromatic nozzle group.

Figure 16:
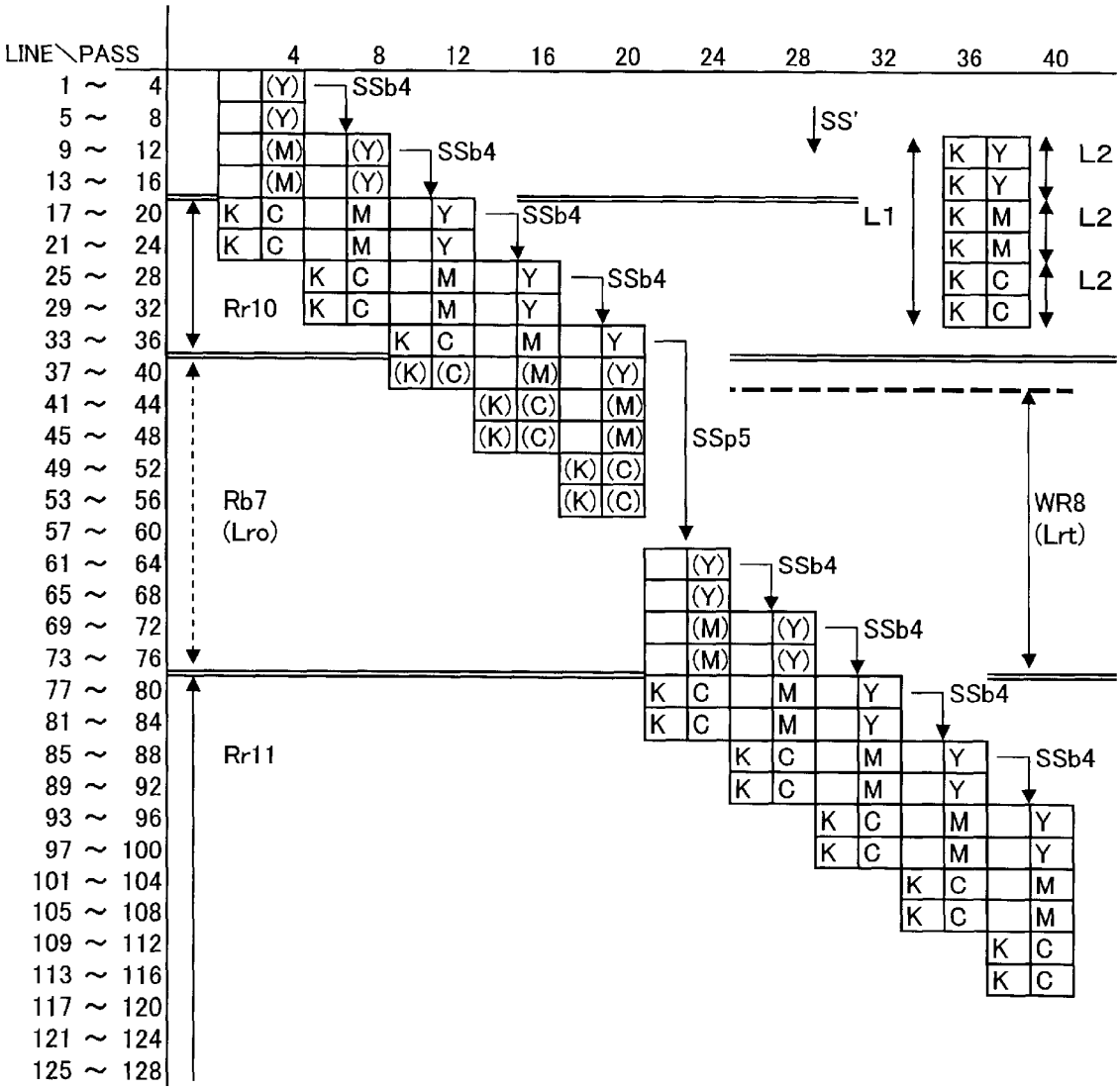
FIG. 16 is a schematic diagram showing how image data comprising dot recording areas and blank areas is recorded in the fifth embodiment.

FIG. 16 is a schematic diagram showing how image data comprising dot recording areas and blank areas is recorded in the fifth embodiment. Next, the manner in which image data comprising dot recording areas and blank areas is recorded, will be explained using FIG. 16. In the fifth embodiment, a first dot recording area Rr10 in which dots are to be formed, a first blank area Rb7 in which dots are not formed, and a second dot recording area Rr11 in which dots are to be formed exist in order on printing paper in the sub-scan direction as shown in FIG. 16.

In example of FIG. 16, the 17th through the 36th lines are the first dot recording area Rr10, the 37th through the 76th lines are the first blank area Rb7, and the 77th line and beyond is the second dot recording area Rr11. In FIG. 16, the print head is represented by six rows×two columns of squares. And C, M, Y, K, which represent the colors of ink corresponding to each square, are shown. However, ink color indicator K is not shown in the squares corresponding to #1 through #4 of the black nozzle group, which is not utilized in color printing.

Figure 17:
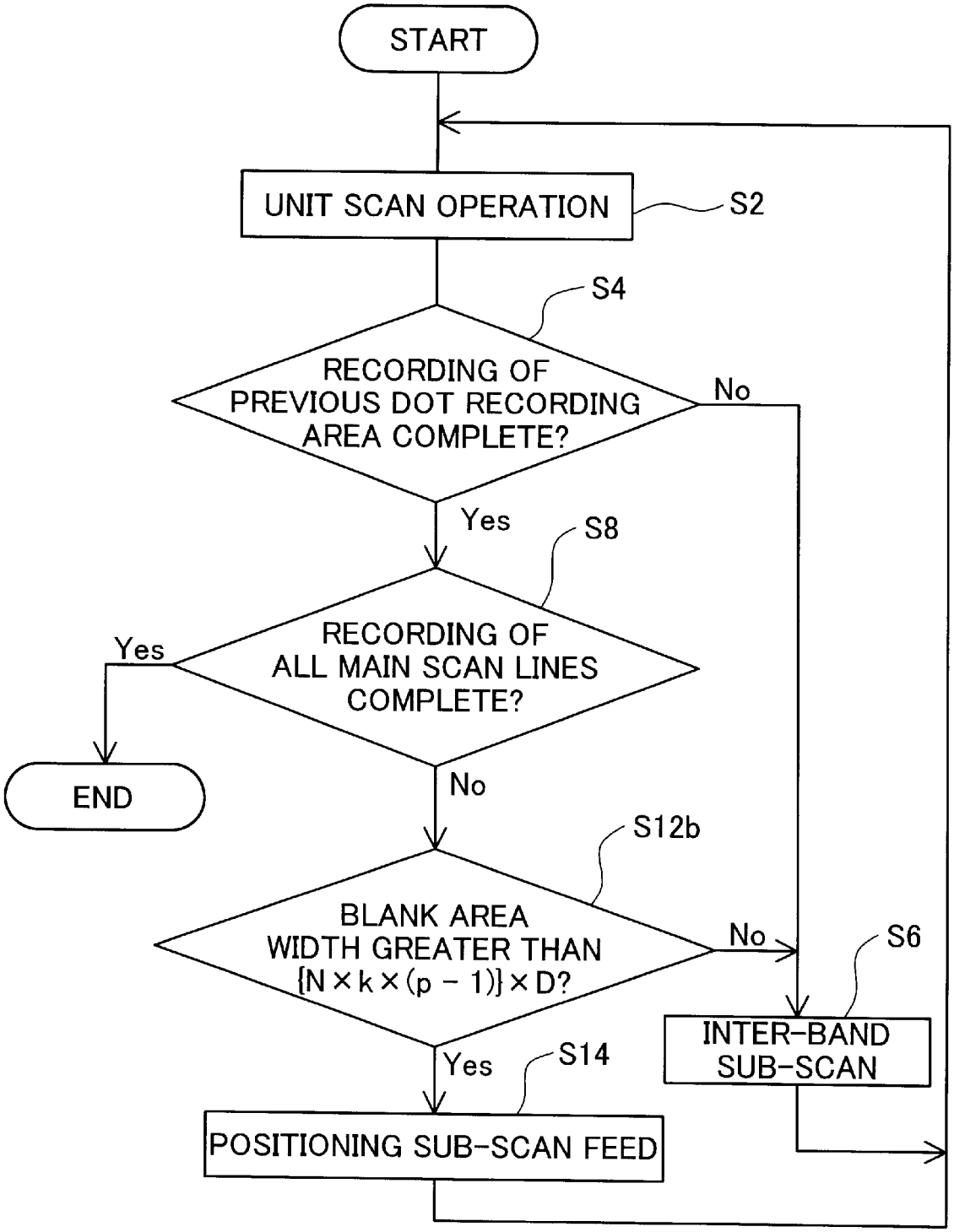
FIG. 17 is a flowchart showing the printing procedures in the fifth embodiment.

FIG. 17 is a flowchart showing the printing procedures of the fifth embodiment. This flowchart differs from the flowchart of FIG. 5 in that it does not comprise Steps S10 and S12, but instead comprises Step S12*b*. The other points are the same as the flowchart of FIG. 5.

At printing time, first, a unit scan operation is executed in Step S2. In Step S2, black and cyan dots are recorded in the 17th through the 24th lines of the first dot recording area Rr10 by an initial unit scan operation. In the fifth embodiment, because a unit scan operation comprises four main scans, more specifically, black and cyan dots are recorded in the 17th through the 24th lines by the first through the fourth passes. In the initial unit scan operation, dots can be recorded with yellow and magenta ink in the first through the 16th lines. However, since the first through the 16th lines are not a dot recording area, dots are not recorded in them. Furthermore, in FIG. 16, when dot recording is not performed, the symbols representing the ink colors are displayed in parentheses ( ).

When the initial unit scan operation is over, a determination is made in Step S4 as to whether or not the recording of the first dot recording area, which was recorded by the previous Step S2 unit scan operation, is complete. In the state, wherein the initial unit scan operation has been completed, dots have yet to be recorded in the 25th through the 36th lines of the first dot recording area Rr10, and only black and cyan dots have been recorded in the 17th through the 24th lines. Accordingly, the result of the determination in Step S4 is "No."

When the result of the determination in Step S4 is "No," an inter-band sub-scan of feed amount SSb4 is executed in Step S6. The feed amount SSb4 of the inter-band sub-scan, as explained hereinabove, is five dots.

Next, a unit scan operation is once again performed by Step S2. This unit scan operation comprises the fifth through the eighth passes in FIG. 16. In this second unit scan operation, as shown in FIG. 16, the 25th through the 32nd lines are recorded with black and cyan ink, and the 17th through the 24th lines are recorded with magenta ink.

Thereafter, a third unit scan operation is performed by Step S2 by way of Steps S4 and S6. This unit scan operation comprises the ninth through the 12th passes in FIG. 16. In this third unit scan operation, as shown in FIG. 16, the 33rd through the 36th lines are recorded in black and cyan ink. Further, the 25th through the 32nd lines are recorded in magenta ink, and the 17th through the 24th lines are recorded in yellow ink. In the third unit scan operation, the 37th through the 40th lines can also be recorded in black and cyan inks, but since these main scan lines belong to the first blank area Rb7, dots are not recorded in them. Fourth and fifth unit scan operations are also performed in the same manner.

In Step S2, when the fifth unit scan operation, comprising the 17th through the 20th passes, is executed, a determination is made in Step S4 as to whether or not the recording of the first dot recording area, which was recorded by the previous Step S2 unit scan operation, is complete. In the state, wherein the fifth unit scan operation has been completed, as is clear from FIG. 16, the 17th through the 36th lines are all recorded in the respective colors K, C, M, Y. That is, the recording of all the main scan lines on the first dot recording area has been completed. Therefore, the result of the determination of Step S4 is "Yes."

When the result of the determination in Step S4 constitutes "Yes," a determination is made in Step S8 as to whether or not the recording of all the main scan lines has been completed. In FIG. 16, in the state, wherein the third unit scan operation is over, since the recording of the second dot recording area has yet to be completed, the result of the determination is "No."

When the result of the determination made in Step S8 was "No," a determination is next made in Step S12*b*. In Step S12*b*, a determination is made as to whether or not the width Lro of the first blank area Rb7, comprising the main scan line of below and adjacent to the lower end nozzle #2 of the yellow nozzle row (the 41st line in FIG. 16), is greater than $\{N \times k \times (p-1)\} \times D$. Here, p is the number of nozzle groups, which are in different positions with regard to the sub-scan direction. Further, the blank area, which is being checked as to width, is the blank area comprising the main scan line of below and adjacent to the nozzle (nozzle #2 in the fifth embodiment), which is positioned at the lower end of the nozzle group (the yellow nozzle group in the fifth embodiment) comprising the upper end nozzle.

In the fifth embodiment, as can be seen from FIG. 13, p is three. That is, the three nozzle groups of the yellow nozzle group, the magenta nozzle group, and the cyan nozzle group are disposed in positions that wall not overlap with one another in the sub-scan direction. Thus, the nozzles comprising these nozzle groups are arranged at a fixed nozzle pitch k×D. As shown in FIG. 15, the nozzle pitch between nozzles belonging to different nozzle groups, that is, the pitch between nozzle #2 of the yellow nozzle group and nozzle #1 of the magenta nozzle group, and the pitch between nozzle #2 of the magenta nozzle group and nozzle #1 of the cyan nozzle group is k×D.

In the fifth embodiment, the number of main scan lines Lro of the first blank area Rb7 is 40 dots. In relation to this, because N is 2, k is 4 and p is 3, {N×k×(p−1)} is 16 dots. Accordingly, the result of the determination of Step S12 constitutes "Yes."

When the result of the determination of Step S12 is "Yes," a positioning sub-scan feed is performed in Step S14. This positioning sub-scan feed is carried out such that nozzle #1 of the upper end of the black and cyan nozzle groups, which are positioned in the lower end of the sub-scan direction, is positioned over the 77th line, which is the main scan line of the upper end of the second dot recording area Rr11. In the fifth embodiment, the black and cyan nozzle groups are nozzle groups, in which the nozzles at the upper ends of the respective nozzle groups are positioned the lowest with regard to the sub-scan direction among nozzle groups. These black and cyan nozzle groups are the "lower end nozzle groups" referred to in the Claims. That is, when there is a plurality of nozzle groups, in which the upper end nozzles within the respective nozzle groups are positioned the lowest in the sub-scan direction, both of these nozzle groups correspond to the "lower end nozzle group." When the nozzles in all of the nozzle groups are arranged so that each is lined up in the main scan direction, then all the nozzle groups correspond to the "lower end nozzle group."

The feed amount SSp5 of the positioning sub-scan feed can be calculated using {Lrt−N×k×(p−2)}×D. Here, Lrt is the number of main scan lines of the remaining area WR8, from the main scan line (the 41st line in FIG. 16) positioned below and adjacent to nozzle #2, which is the lower end nozzle of the yellow nozzle group, to the main scan line of the lower end of the blank area (the 76th line in FIG. 16). In the fifth embodiment, because the Lrt subsequent to the 20th pass is 36 dots, K is 4, N is 2 and p is 3, the feed amount SSp5 of the positioning sub-scan feed is 28 dots. The positioning sub-scan feed of Step S14 is executed in this manner by the positioning sub-scan feed unit 41*b* of CPU 41 (refer to FIG. 3). The yellow nozzle group in the fifth embodiment is the nozzle group comprising the uppermost nozzle of the nozzles used in a unit scan operation. This yellow nozzle group is equivalent to the "upper end nozzle group" referred to in the Claims.

Thereafter, a unit scan operation is performed once again in Step S2. This unit scan operation is the 21st pass in FIG. 16. In the 21st pass, the 77th through the 84th lines are recorded in black and cyan inks. Hereinafter, dots are formed in the same way in each of the dot recording areas of the printing paper by Steps S2 through S14. When dots are formed in all the main scan lines of these dot recording areas, the result of the determination in Step S8 becomes "Yes," and processing ends.

Figure 18:
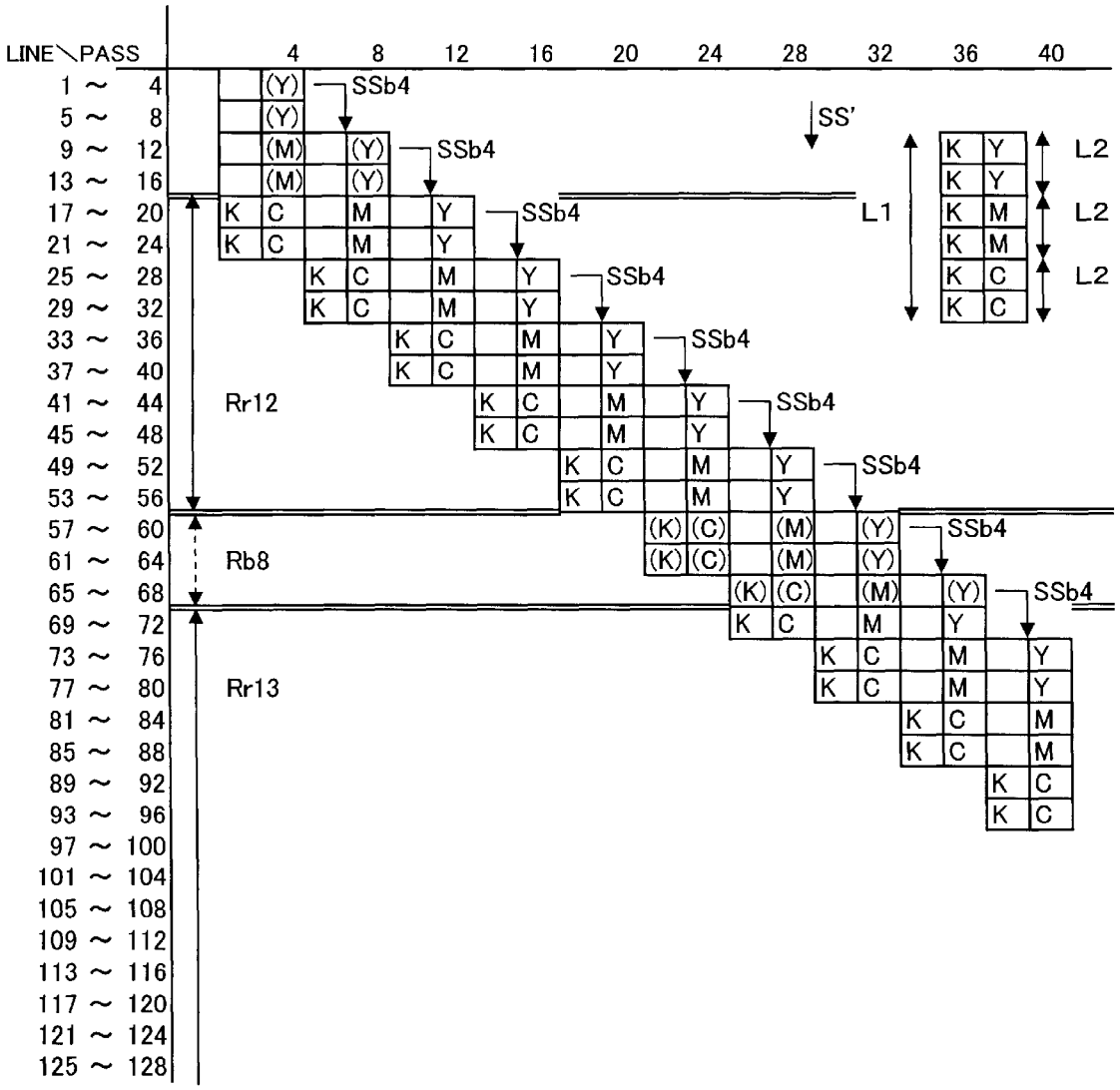
FIG. 18 is a schematic diagram showing how image data comprising dot recording areas and blank areas is recorded in another example.

FIG. 18 is a schematic diagram showing how image data comprising dot recording areas and blank areas is recorded in another example. In the example of FIG. 18, a first dot recording area Rr12 in which dots are to be formed, a first blank area Rb8 in which dots are not formed, and a second dot recording area Rr13 in which dots are to be formed, as shown in FIG. 18, exist in order in the sub-scan direction on the printing paper. The first blank area Rb8 is from the 57th line to the 68th line, and the width of this area in the sub-scan direction is 12 lines. {N×k×(p−1)}×D of Step S12*b* (refer to FIG. 18) is 16 dots. For this reason, in the comparative example of FIG. 18, the result of the determination of Step S12*b* subsequent to the 20th pass constitutes "No." In this case, once again an inter-band sub-scan is executed in Step S6, and a unit scan operation is performed in Step S2.

In the fifth embodiment, when the width Lro of blank area Rb7 is greater than {N×k×(p−1)}×D, a positioning sub-scan feed is carried out. That is, a positioning sub-scan feed is carried out when the feed amount of a positioning sub-scan feed is greater than a feed amount of two times the width of a color unit band (N×k). Therefore, it is possible to make the feed amount of a positioning sub-scan feed larger than the feed amount of an inter-band sub-scan. Accordingly, by performing a positioning sub-scan feed, it is possible to shorten the time required for printing. Furthermore, because k=1 when the nozzle pitch is equivalent to the main scan line pitch, the blank area width Lro is compared against {N×(p−1)}×D. Further, when the number of lines of a color unit line and the number of lines of a color unit band differ, it is desirable to make a determination as to whether or not the blank area width Lro is greater than (p−1) times the number of lines of the color unit band, and whether or not a positioning sub-scan feed should be carried out.

Further, in the fifth embodiment, because the feed amount of a positioning sub-scan feed is set at {Lrt−N×k×(p−2)}×D, a positioning sub-scan feed can be performed such that the upper end nozzle of the nozzle group positioned at the lower end of the sub-scan direction is positioned over the main scan line of the upper end of the next dot recording area. Furthermore, because k=1 when the nozzle pitch is equivalent to the main scan line pitch, the feed amount of a positioning sub-scan feed becomes {Lrt−N×(p−2)}×D.

F. Sixth Embodiment

In the sixth embodiment of the present invention, an embodiment of the method is described which is used to determine the feed amount for the positioning sub-scan feed. The configuration of printer 20 and computer 88 in the sixth embodiment is the same as for the second embodiment.

Figure 19:
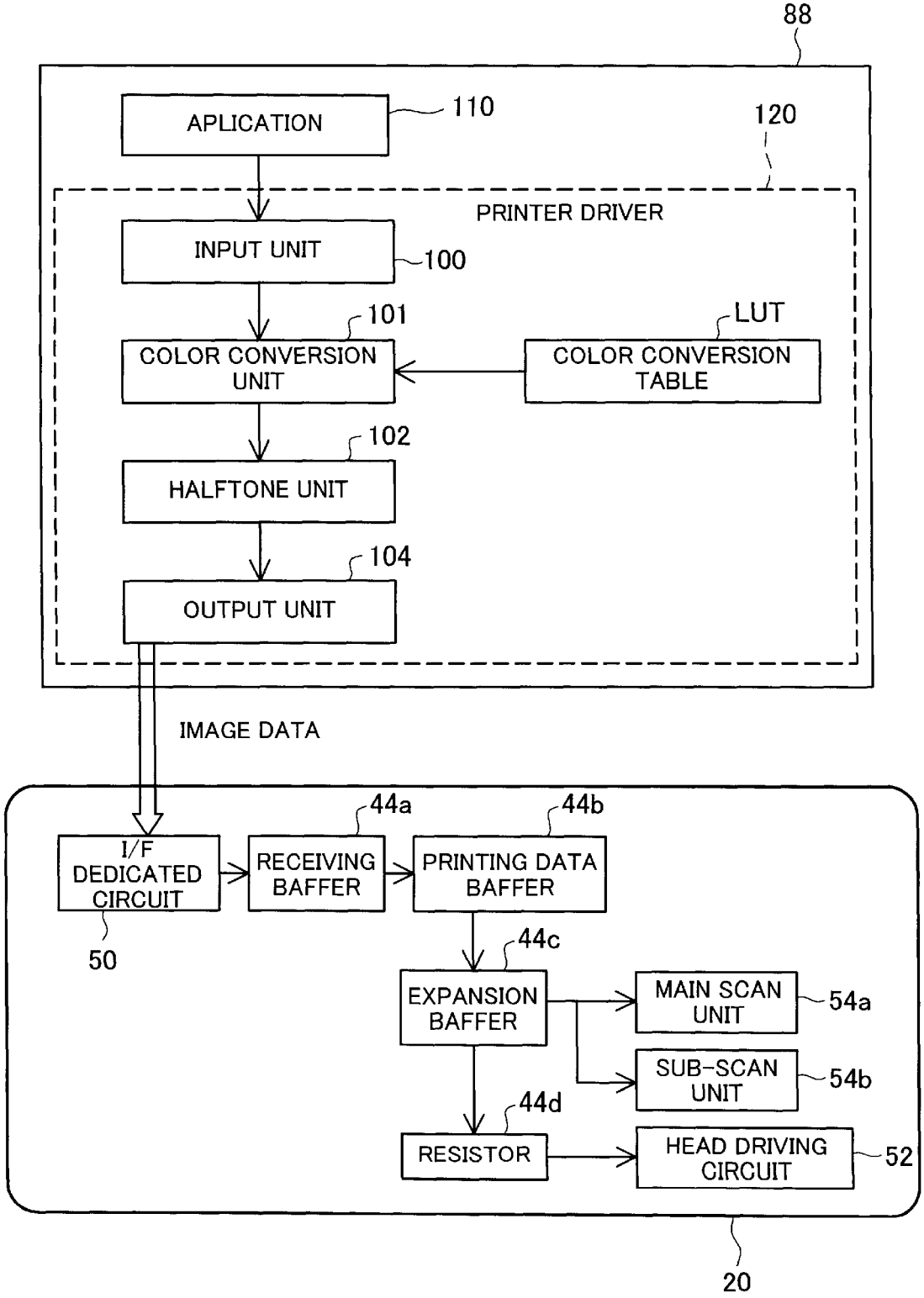
FIG. 19 is an explanatory diagram of a functional block for computer 88 and printer 20.

FIG. 19 is an explanatory diagram of a functional block for computer 88 and printer 20. In computer 88, application program 110 operates under a specific operating system. Print driver 110 is built into the operating system. Application program 110 generates image data. Then, printer driver 120 converts the image data to a printable format for printer 20.

Printer driver 120 is provided with a variety of functional units, namely, input unit 100, color conversion unit 101, color conversion table LUT, halftone unit 102 and output unit 104.

When application program 110 issues a printing instruction, input unit 100 receives image data and stores them temporarily. Color conversion unit 101 carries out color conversion in which the color components of the image data are converted to the color components of ink used in printer 20. Color conversion is carried out by referencing color conversion table LUT in which are stored the relationships between the color components used in the image data and the color components of the ink in printer 20. Halftone unit 102 carries out halftone processing to the image data which have been color-converted so that the gradation value of each pixel can be expressed with the dot recording density. The image data which have been converted in this way are outputted to printer 20 as output signals PS in single units for each scanning line starting from the top of the image data.

Image data sent from printer driver 120 are received via an interface dedicated circuit 50 and are stored in RAM 44 (see FIG. 3). The function of this RAM 44 is indicated in FIG. 19 as receiving buffer 44*a*. Besides this, RAM 44 also functions as printing data buffer 44*b*, expansion buffer 44*c* and register 44*d*. These functional units are also indicated in FIG. 19.

CPU 41 (see FIG. 3) rearranges the image data recorded in receiving buffer 44*a* in the order recorded in printer 20, that is, in the sequence of the passes in printer 20, and generates printing data. At this time, CPU 41 also generates data such as moving speed for the carriage in each pass, the feed amount for the sub-scan carried out in the intervals between passes and other data, and incorporates it into the printing data. Then, CPU 14 stores the printing data in printing data buffer 44*b*. Further, by "pass" is meant a single main scan carried out for dot formation. Although the term "printing data" is used here in the narrow sense to indicate data which have been rearranged by CPU 41 in the sequence of the passes, it also indicates in the broad sense data in steps which have been converted and processed for a variety of formats before and after this.

After this, data for a single pass are sent successively from printing data buffer 44*b* to expansion buffer 44*c* by CPU 41, as is indicated in FIG. 19 (see FIG. 3). Dot formation information contained in a single pass for all of the nozzles used for a single main scan are stored in these data. This means that data for a plurality of n multiple main scan lines in which dots are recorded with a single main scan are stored in the data sent to expansion buffer 44*c*. Specific processing is carried out based on the dot formation information for a single pass and the feed amount for positioning sub-scan feed is determined. The feed amount for positioning sub-scan feed is discussed further on.

Dot formation information for a single pixel for each nozzle is taken from dot formation information for a single pass for all of the nozzles in the expansion buffer 44*c*, in the sequence in which each of the nozzles forms the dots and sent to register 44*d*. This means that the dot formation information for pixels arranged in a direction which intersects with the main scan line (sub-scan direction, direction of the row) are taken in parallel from dot formation information for the multiple main scan lines and the dot formation information for pixels are sent to register 44*d* in sequence.

After this, CPU 41 converts the data in register 44*d* to the serial data and sends them to head driving circuit 52. Then, head driving circuit 52 drives the head according to the serial data and prints the image. Meanwhile, the data which indicate how to execute the main scan feeding and the data which indicate how to execute the sub-scan feeding are taken from the data in a single pass inside expansion buffer 44*c* and are sent to motor drive circuit 54. FIG. 19 indicates main scan unit 54*a* which controls carriage motor 24 as a functional unit for motor drive circuit 54 and sub-scan unit 54*b* which controls paper feed motor 22. Main scan unit 54*a* carries out main scanning for the head and sub-scan unit 54*b* sent the printing paper according to the data respectively.

Figure 20:
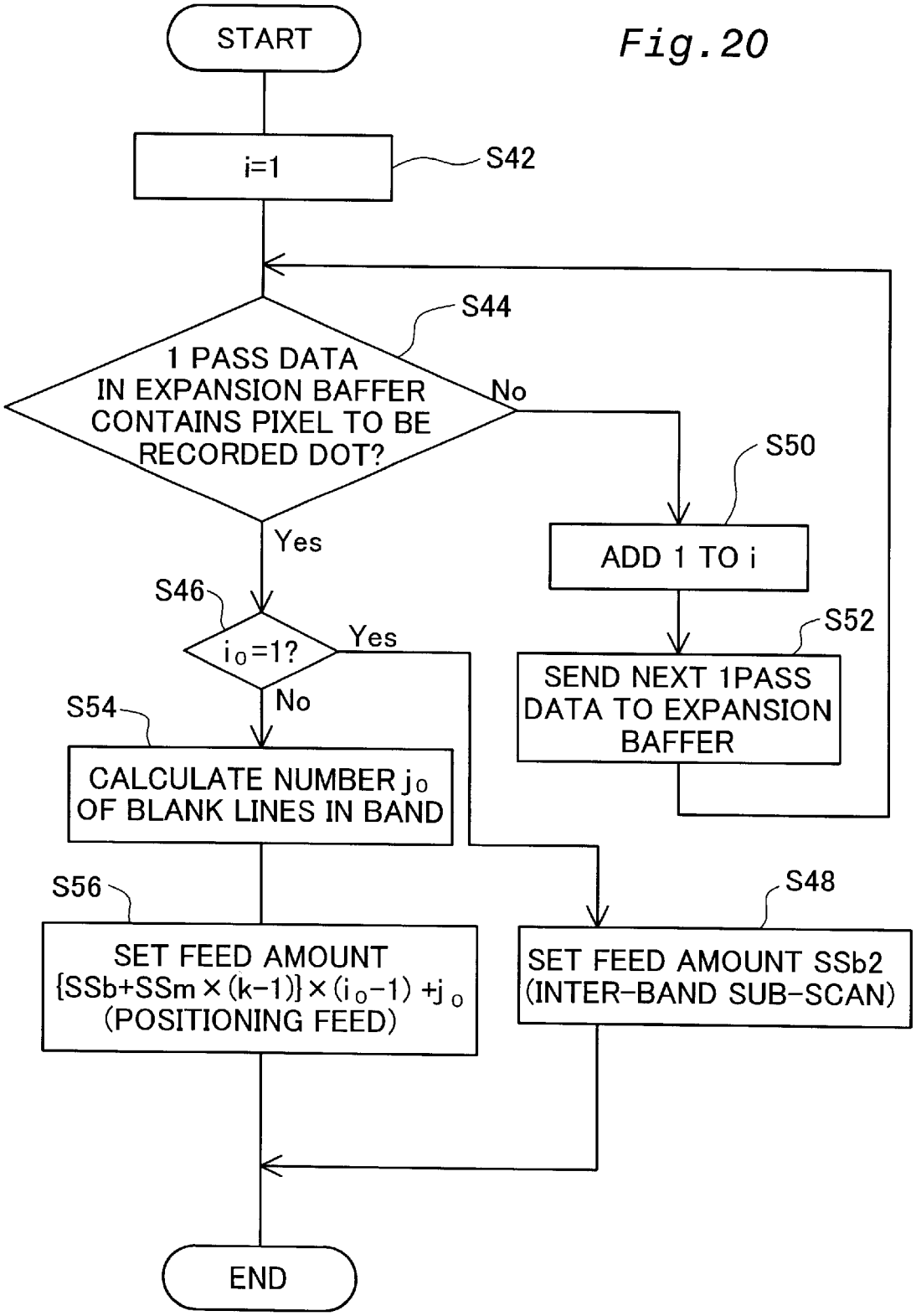
FIG. 20 is a flow chart which indicates the sequence in which the sub-scan feed amount is determined.

FIG. 20 is a flow chart which indicates the sequence in which the sub-scan feed amount is determined. CPU 41 carries out the processing indicated in FIG. 20 for the data for a single pass in the expansion buffer 44*c*. First, in Step 42, counter i is placed at 1. Then, in Step 44, the data for a single pass in expansion buffer 44*c* are studied. The data for a single pass in the expansion buffer 44*c* are printing data which are used for printing for the aggregate of main scan lines that allow the nozzle groups to record dots when it is assumed that the next inter-band sub-scan and the unit scan operation has been executed. CPU 41 studies whether or not the printing data for the aggregate of main scan lines include the pixel data which are to record the dots.

When the printing data for the aggregate of main scan lines to be studied include pixel data which are to record the dots, the processing in the next Step S46 is carried out. The value of counter i at this time is set to io. In Step S46, a determination is made as to whether io is 1 or not. When io is 1 and the determination result in step S46 is "Yes", the sub-scan feed amount is set SSb2 of inter-band sub-scan feed amount in Step S48 and the processing is completed. The processing when io is not 1 is explained later.

The printing data for the aggregate of main scan lines which are to be studied do not include pixel data in which dots are to be recorded and the determination result in Step S44 is "No", CPU 41 adds 1 to counter i in Step S50. Then, in Step S52, the data for the aggregate of main scan lines are sent from printing data buffer 44*b* to expansion buffer 44*c*. The aggregate of main scan lines are main scan lines to be recorded in the next pass when it is assumed that sub-scanning of the feed amount $\{SSb\times i+SSm\times(k-1)\times(i-1)\}$ has carried out. Further, SSb is the inter-band sub-scan feed amount. SSm is the feed amount for the sub-scanning carried out in the unit scanning operation. Then, k is the nozzle pitch. After this, the process returns to Step S44.

In Step S44, data for the i-st pass, that is, the second pass, are studied. When the data for the i-th pass do not contain pixel data for which dots are to be recorded, that is, when the determination result for Step S44 is "No", the Step S50, Step S52 loop is repeated.

When the pixel data for the i-th pass do include pixel data in which the dots are to be recorded, that is, when the determination result for Step S44 is "Yes", a determination is made whether or not io is 1 in Step S46. When io is 2 or more and the determination result for Step S46 is "No", the processing in Step S54 is carried out. In Step S54, a check is made to see how many lines are contained in "inner-band blank lines" in the data for the io-th pass which contains pixel data in which the dots are to be recorded. "The inner-band blank lines" are main scan lines that do not contain a pixel to be recorded a dot and are lined up without gaps in the sub-scan direction from the top of the aggregate of main scan lines which has been determined to include pixels for which dots are to be recorded.

Thereafter, in Step S56, the sub-scan feed amount is set to SSp which was obtained using the following formula (1) and processing is completed.

$$SSp=\{SSb+SSm\times(k-1)\}\times(io-1)+jo \quad (1)$$

Further, since it was assumed that the printing is executed in accordance with the second embodiment in which the main scan line pitch is smaller than the nozzle pitch, the feed amount of the positioning sub-scan feed SSp was found using formula (1) above. When printing is executed in accordance with the first embodiment in which the main scan line pitch is equal to the nozzle pitch, the feed amount of the positioning sub-scan feed SSP is found using formula (2) as follows. Formula (2) is equivalent to the formula in which k=1 is substituted in formula (1).

$$SSp=SSb\times(io-1)+jo \quad (2)$$

Likewise, when printing is executed in accordance with the first embodiment in which the main scan line pitch is identical to the nozzle pitch, in Step S52, the data for one pass, when sub-scanning of the feed amount (SSb×i) is carried out, are sent to the expansion buffer. Further, if k=1, the feed amount (SSb×i+SSm×(k−1)×(i−1), which was explained in Step S52, becomes (SSb×i).

CPU 41 again takes the data for one pass from printing data buffer 44*b* to expansion buffer 44*c*, so that the main scan line, which includes pixels to be recorded dot in the io-th aggregate of main scan lines mentioned above, coincides with the main scan line on the top end of the main scan lines (unit lines) corresponding to the one pass. Then, the dot forming information for a single pixel in each nozzle are taken from the dot forming information for a single pass in all of the nozzles in expansion buffer 44*c*, and are sent to register 44*d*. Meanwhile, CPU 41 designates feed amount SSp for the sub-scan feed found using formula (1) to sub-scan unit 54*b* (see FIG. 19).

The feed amount for the sub-scan feed indicated in FIG. 7 can also be determined in this way. With this embodiment, the feed amount for the positioning sub-scan feed can be set by handling the data for a single pass without handling all of the data for the pixels to be printed at one time. Thus, the capacity of a RAM 44 in printer 20 can be reduced. In addition, the time required for CPU 41 to determine the feed amount for positioning sub-scan feed can be shortened.

Figure 21:
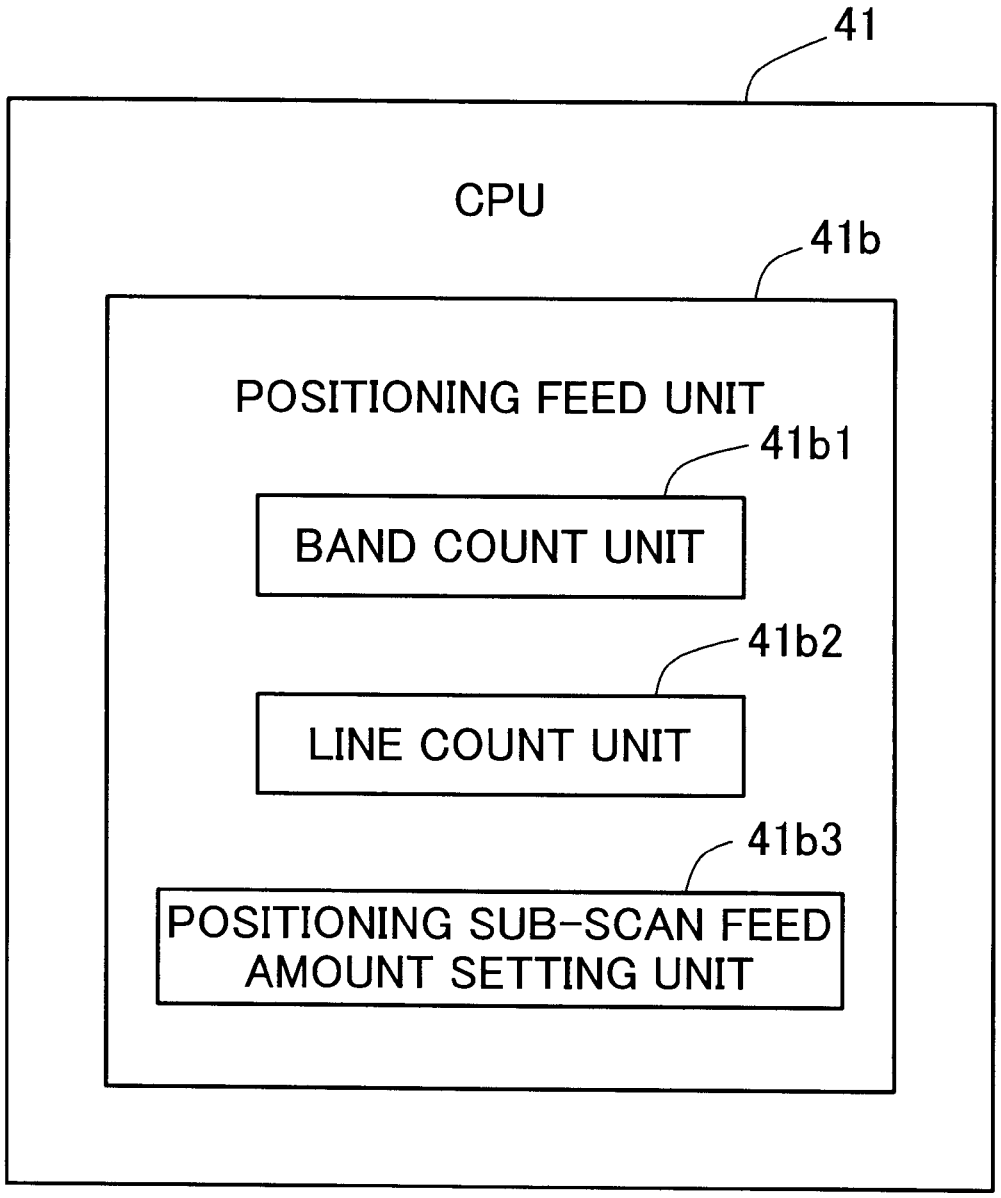
FIG. 21 is a block diagram of the functional unit of CPU 41 in printer 20.

FIG. 21 is a block diagram of the functional unit of CPU 41 in printer 20. CPU 41 on printer 20 carries out the processing which was explained above. A band count unit 41*b* 1, a line count unit 41*b*2 and a positioning feed amount setting unit 41*b*3 are indicated as still lower functional units for positioning unit 41*b* which is a functional unit for CPU 41. CPU 41 executes a computer program stored in PROM43 thereby accomplishing the function of these functioning units. The band count unit 41*b*1 handles processing for step S44 and S50 and S52 in FIG. 20; the line count unit 41*b*2 handles Step S54 and the positioning feed amount setting unit 41*b*3 handles Step S56. In addition, the positioning feed amount setting unit 41*b*3 in CPU 41, the sub-scan unit 54*b* in motor drive circuit 54 and the paper feed motor 22 collectively are correspond to the "the positioning sub-scan feed execution unit" mentioned in Claims.

G. Seventh Embodiment:

The functions explained in the sixth embodiment with FIG. 20 and FIG. 21 could be carried out using the print driver. This type of embodiment will explained in the seventh embodiment.

Figure 22:
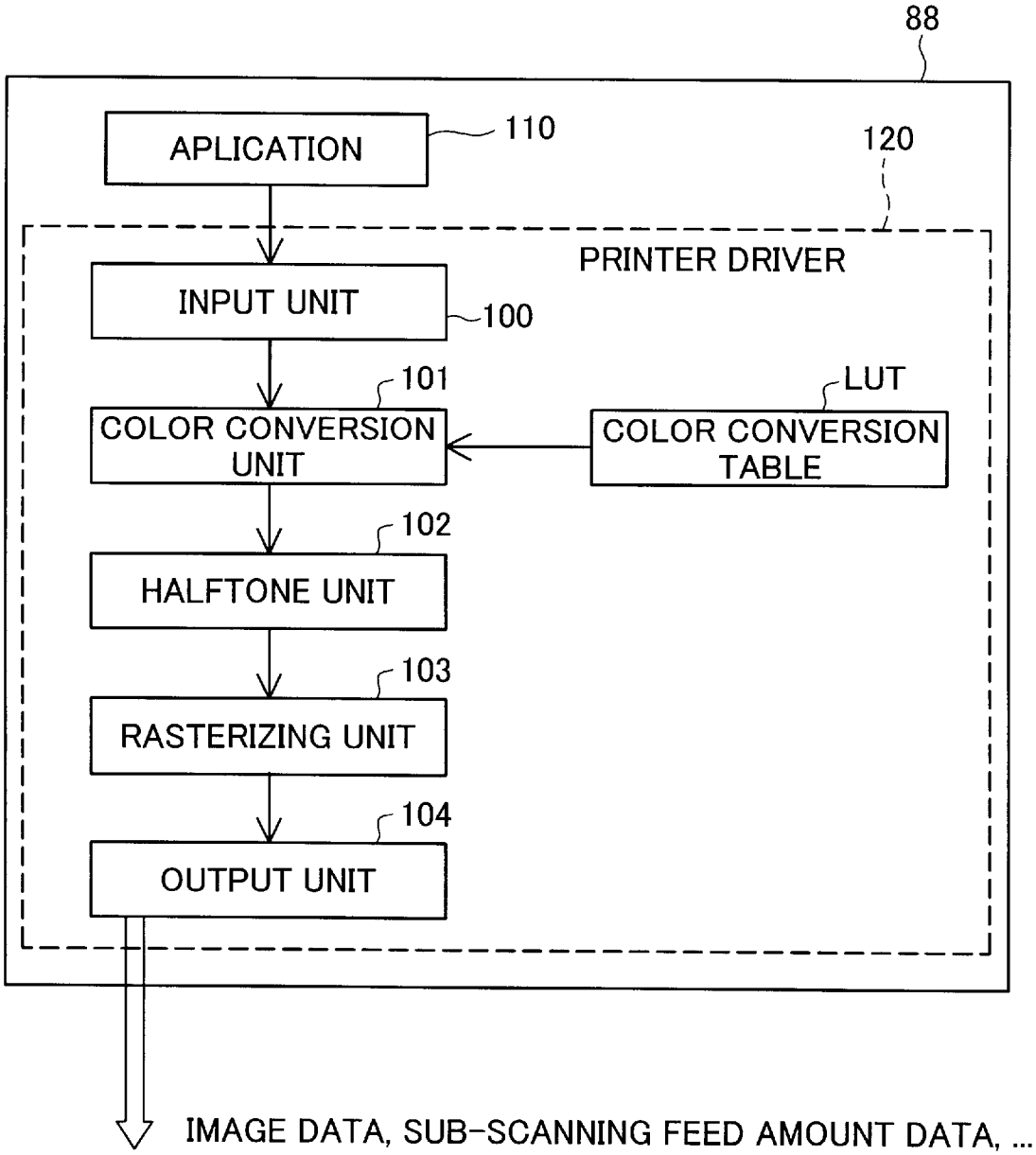
FIG. 22 is an explanatory diagram of the functional block in computer 88.

FIG. 22 is an explanatory diagram of the functional block in computer 88. Except for print driver 120 which is provided with a rasterizing unit 103, it is identical to the block diagram of computer 88 indicated in FIG. 19. Image data which are subjected to halftone processing by halftone unit 120 are rearranged by rasterizing unit 103 in the sequence of the data to be transferred to printer 22 and are outputted from output unit 104 as the final print data. This print data contains raster data which represent the recording status of the dots when each of the main scans is carried out and contain data indicating the sub-scan feed amount.

When processing is carried out in accordance with this printing data, sometimes a unit scan operation is performed while executing inter-band sub-scans by a predetermined second feed amount SSb between unit scan operations for forming dots on the main scan line of the first dot recording area. The unit scan operation comprises k main scans and (k−1) sub-scans executed between the respective main scans by a predetermined first feed amount SSm. The portions of this printing data which carry out this type of printing processing are called as "band recording data".

In addition, when processing is carried out in accordance with this printing data, sometimes a positioning sub-scan feed is carried out for executing a sub-scan to obtain a relative position where an upper end main scan line of a unit band coincides with a main scan line of an upper end of the second dot recording area. The unit band is a bundle of main scan lines lined up without gaps in the sub-scan direction that allow the nozzle groups to record dots when it is assumed that the unit scan operation has been executed once. The portions of this printing data which carries out this type of processing are called as "positioning sub-scan feed data".

These printing data correspond to the data in printing data buffer 44*b* in the embodiment indicated in FIG. 19. Thus, rasterizing unit 103 functions as the "band recording data generating unit" and the "positioning sub-scan feed data generating unit" mentioned in Claims.

The rasterizing unit 103 carries out the processing indicated in FIG. 20 when it generates raster data and the data indicating the sub-scan feed amount. This means that when a set of main scan lines for one pass contains pixel data to be recorded dots, printing data are generated so that the usual inter-band sub-scanning is carried out (see Steps S44, S46 and S48). Then, when a set of main scan lines for one pass does not contain pixel data to be recorded dots, printing data are generated so that a specified amount of positioning sub-scan feed can be carried out (see Steps S50, S52, S54 and S56). However, this does not mean that printer driver 120 uses expansion buffer 44*c*. In the step which corresponds to Step S44, the data for one pass scheduled to be recorded after the sub-scan currently calculated the feed amount is taken for studying whether it includes the pixel data which are to record the dots. Then, in the step corresponding to Step S52, a study is made of the main scan line data for the following pass when it is assumed that sub-scanning with a feed amount of (SSb×i+SSm×(k−1)×(i−1) has been carried out.

With this embodiment, image data which contain a dot recording area and a blank area in the sub-scanning direction can be printed efficiently. If an embodiment is used wherein the feed amount is set using the printer driver, the burden of processing on the printer side can be reduced.

H. Variation:

Furthermore, the present invention is not limited to the above-mentioned embodiments or aspects, and can be implemented in a variety of modes whose scopes do not deviate from the gist thereof. For example, a variation such as the following is also possible.

In the second, third and fifth embodiments, the nozzle pitch was four times the main scan line pitch, but the nozzle pitch k is not limited to four, and can be 6, 8 or some other suitable value. In this case, it is desirable for the feed amount of a micro-feed performed in a unit scan operation to have one dot or constitute prime with the nozzle pitch k. By so doing, it is possible to execute a sub-scan at a fixed feed amount, and to record the respective main scan lines without gaps. Further, it is desirable to set the number of micro-feeds to (k−1).

Further, in the fourth embodiment, the achromatic nozzle group was the nozzle group for ejecting black ink, but when printing data comprises an area to be recorded using a single color other than black, it is also possible to constitute the present invention such that the ink for recording this area is ejected from the achromatic nozzle group. Furthermore, two or more achromatic nozzle groups can be provided. In this case, it is desirable for the number of nozzles in each achromatic nozzle group to be the same.

In other words, the print head can be constituted so as to comprise nozzle groups each comprising a plurality of nozzles, each of which are nozzles for ejecting drops of ink, and which are arranged at a nozzle pitch k×D of k times (where k is an integer of 2 or greater) the main scan line pitch D.

Then, using a print head such as this, the present invention can be applied to printing, which performs unit scan operations comprising k main scans, and (k−1) sub-scans of a prescribed first feed amount SSm carried out between the respective main scans, and which executes inter-band sub-scans of a prescribed second feed amount SSb between each unit scan operation.

Further, the print head can also be constituted as a print head, which comprises a nozzle group comprising N (where N is an integer of 2 or greater) nozzles, each of which are nozzles for ejecting drops of ink, and which are arranged at a nozzle pitch D equivalent to the main scan line pitch D.

In the fifth embodiment, a positioning sub-scan feed is performed such that the nozzles of the upper ends of the black and cyan nozzle groups, which are positioned at the lower end of the sub-scan direction, will be positioned above the main scan line (77th line) of the upper end of the second dot recording area Rr11. However, when the sub-scans within a unit scan operation are preformed at a feed amount of two dots or more rather than a feed amount of one dot, it is desirable for a positioning sub-scan feed to be executed as follows. That is, after the recording of dots to the first dot recording area has been completed, a sub-scan is executed up to a relative position, at which the main scan line of the upper end of a unit band coincides with the main scan line of the upper end of the second dot recording area. Furthermore, a "unit band" is a bundle of main scan lines, which a nozzle group can record without gaps in the sub-scan direction when it is supposed that a unit scan operation will be executed once. By doing so, color printing can be performed without gaps from the upper end of the second dot recording area.

In each of the above embodiments, ink jet printers were explained, but the present invention is not limited to an ink jet printer, and can generally be applied to a variety of printing apparatus, which perform printing using a print head. Further, the present invention is not limited as to the method or device for ejecting ink drops, but rather can also be applied to methods and devices for recording dots via other means.

In each of the above embodiments, software can be substituted for a portion of the constitution achieved by hardware, and conversely, hardware can be substituted for a portion of the constitution achieved via software. For example, it is also possible to achieve a portion of the functionality of the head driving circuit 52 shown in FIG. 3 using software.

What is claimed is:

1. A method for printing on a printing medium by depositing drops of ink to form dots on the printing medium while executing a main scan by use of a nozzle group comprising N (where N is an integer of 2 or greater) nozzles for ejecting drops of ink which are arrayed at a nozzle pitch D equivalent to a main scan line pitch D; and by executing sub-scans between the main scans in a sub-scan direction that intersects with a direction of the main scan, the method comprising the step of:

reproducing first and second dot recording areas in which dots are to be formed, and a blank area inserted between the first and second dot recording areas in the sub-scan direction, wherein the step of reproducing includes the steps of:

(a) performing a unit scan operation which comprises a single main scan for forming dots on main scan lines of the first dot recording area, while executing an inter-band sub-scan according to a predetermined feed amount SSb between the respective unit scan operations; and (b) after completing the forming of dots in the first dot recording area, carrying out a positioning sub-scan feed to obtain a relative position at which a position of an upper end nozzle of the N nozzles coincides with a position of an upper end main scan line of the second dot recording area in the sub-scan direction.

2. A printing method according to claim 1, wherein a feed amount of the positioning sub-scan feed is (SSb+Lr)×D, when Lr represents a number of main scan lines counted from a main scan line immediately below to a main scan line where a lower end nozzle of nozzles used in the unit scan operation is positioned in a state where the unit scan operation executed immediately before the positioning feed has ended, to a lower end main scan line of the blank area.

3. A printing method according to claim 1, wherein the step (b) is executed only when a specific main scan line is included in the blank area and a number of main scan lines Lr is N or more, the specific main scan line being a line positioned immediately below to a main scan line where a lower end nozzle of nozzles used in the unit scan operation is positioned when an unit scan operation executed immediately before the positioning sub-scan has ended, Lr being a number of main scan lines counted from the specific main scan line to a main scan line at a lower end of the blank area.

4. A printing method according to claim 3, wherein a feed amount of the positioning sub-scan feed is (SSb+Lr)×D.

5. A method for printing on a printing medium by depositing drops of ink to form dots on the printing medium while executing a main scan by use of a plurality of nozzle groups each comprising a plurality of nozzles for ejecting drops of ink which are arrayed at a nozzle pitch D equivalent to a main scan line pitch D, the plurality of nozzle groups including a lower end nozzle group whose upper end nozzle is positioned at a lowermost place among upper end nozzles of the plurality of nozzle groups; and by executing sub-scans between the main scans in a sub-scan direction that intersects with a direction of the main scan, the method comprising the step of:

reproducing first and second dot recording areas in which dots are to be formed, and a blank area inserted between the first and second dot recording areas in the sub-scan direction, wherein the step of reproducing includes the steps of:

(a) performing a unit scan operation which comprises a single main scan for forming dots on main scan lines of the first dot recording area, while executing an inter-band sub-scan according to a predetermined feed amount SSb between the respective unit scan operations; and (b) after completing the forming of dots in the first dot recording area, carrying out a positioning sub-scan feed to obtain a relative position at which a position of an upper end nozzle of the lower end nozzle group coincides with a position of an upper end main scan line of the second dot recording area in the sub-scan direction.

6. A printing method according to claim 5, wherein the nozzle groups are positioned such that they do not overlap one another in a direction perpendicular to the direction of the main scan, and comprise p (where p is an integer of 2 or greater) nozzle groups for ejecting drops of ink of mutually different colors.

7. A printing method according to claim 6, wherein the p nozzle groups each comprise N (where N is an integer of 2 or greater) nozzles;

the nozzles included in each of the p nozzle groups are arranged at a fixed nozzle pitch D in the direction perpendicular to the direction of the main scan; and the step (b) is only executed when a width of the blank area in the direction perpendicular to the direction of the main scan is greater than $\{N\times(p-1)\}\times D$.

8. A printing method according to claim 6, wherein the p nozzle groups each comprise N (where N is an integer of 2 or greater) nozzles;

the p nozzle groups include an upper end nozzle group including an uppermost nozzle of nozzles used in the unit scan operation;

the nozzles included in each of the p nozzle groups are arranged at a fixed nozzle pitch D in the direction perpendicular to the direction of the main scan; and a feed amount of a positioning sub-scan feed is $\{Lrt-N\times(p-2)\}\times D$, when Lrt represents a number of main scan lines counted from a main scan line immediately below to a main scan line where a lower end nozzle of the upper end nozzle group is positioned in a state where a unit scan operation executed immediately before the positioning feed has ended, to a main scan line of a lower end of the blank area.

9. A method for printing on a printing medium by depositing drops of ink to form dots on the printing medium while executing a main scan by use of a nozzle group comprising N (where N is an integer of 2 or greater) nozzles for ejecting drops of ink which are arrayed at a nozzle pitch k×D that is k times (where k is an integer of 2 or greater) a main scan line pitch D; and by executing sub-scans between the main scans in a sub-scan direction that intersects with a direction of the main scan, the method comprising the step of:

reproducing first and second dot recording areas in which dots are to be formed, and a blank area inserted between the first and second dot recording areas in the sub-scan direction, wherein the step of reproducing includes the steps of:

(a) performing a unit scan operation for forming dots on main scan lines of the first dot recording area, the unit scan operation comprising k main scans and (k−1) sub-scans executed between the respective main scans by a predetermined first feed amount SSm, while executing inter-band sub-scans by a predetermined second feed amount SSb between unit scan operations; and (b) after completing the forming of dots in the first dot recording area, carrying out a positioning sub-scan feed to obtain a relative position where an upper end main scan line of a unit band coincides with a main scan line of an upper end of the second dot recording area, the unit band being a bundle of consecutive main scan lines lined up without gaps in the sub-scan direction that are to be printed by the nozzle group when it is assumed that the unit scan operation is executed once after the positioning sub-scan feed.

10. A printing method according to claim 9, wherein a feed amount of the positioning sub-scan feed is $(SSb+Lr)\times D$, when Lr represents a number of main scan lines counted from a main scan line immediately below to a main scan line where a lower end nozzle of nozzles used in the unit scan operation is positioned in a state where a unit scan operation executed immediately before the positioning feed has ended, to a main scan line of a lower end of the blank area.

11. A printing method according to claim 9, wherein the step (b) is executed only when a specific main scan line is included in the blank area and a number of main scan lines Lr is N×k or more, the specific main scan line being a line positioned immediately below to a main scan line where a lower end nozzle of nozzles used in the unit scan operation is positioned when an unit scan operation executed immediately before the positioning sub-scan has ended, Lr being a number of main scan lines counted from the specific main scan line to a main scan line at a lower end of the blank area.

12. A printing method according to claim 11, wherein a feed amount of the positioning sub-scan feed is $(SSb+Lr)\times D$.

13. A method for printing on a printing medium by depositing drops of ink to form dots on the printing medium while executing a main scan by use of a plurality of nozzle groups each comprising a plurality of nozzles for ejecting drops of ink which are arrayed at a nozzle pitch k×D that is k times (where k is an integer of 2 or greater) a main scan line pitch D, the plurality of nozzle groups including a lower end nozzle group whose upper end nozzle is positioned at a lowermost place among upper end nozzles of the plurality of nozzle groups; and by executing sub-scans between the main scans in a sub-scan direction that intersects with a direction of the main scan, the method comprising the step of:

reproducing first and second dot recording areas in which dots are to be formed, and a blank area inserted between the first and second dot recording areas in the sub-scan direction, wherein the step of reproducing includes the steps of:

(a) performing a unit scan operation for forming dots on main scan lines of the first dot recording area, the unit scan operation comprising k main scans and (k−1) sub-scans executed between the respective main scans by a predetermined first feed amount SSm, while executing inter-band sub-scans by a predetermined second feed amount SSb between unit scan operations; and (b) after completing the forming of dots in the first dot recording area, carrying out a positioning sub-scan feed to obtain a relative position where an upper end main scan line of a unit band coincides with a main scan line of an upper end of the second dot recording area, the unit band being a bundle of consecutive main scan lines lined up without gaps in the sub-scan direction that are to be printed by the lower end nozzle group when it is assumed that the unit scan operation is executed once after the positioning sub-scan feed.

14. A printing method according to claim 13, wherein the nozzle groups are positioned such that they do not overlap one another in a direction perpendicular to the direction of the main scan, and comprise p (where p is an integer of 2 or greater) nozzle groups for ejecting drops of ink of mutually different colors.

15. A printing method according to claim 14, wherein the p nozzle groups each comprise N (where N is an integer of 2 or greater) nozzles;

the nozzles included in each of the p nozzle groups are arranged at a fixed nozzle pitch k×D in the direction perpendicular to the direction of the main scan; and the step (b) is only executed when a width of the blank area in the direction perpendicular to the direction of the main scan is greater than $\{N\times k\times(p-1)\}\times D$.

16. A printing method according to claim 14, wherein the p nozzle groups each comprise N (where N is an integer of 2 or greater) nozzles;

the p nozzle groups include an upper end nozzle group including an uppermost nozzle of nozzles used in the unit scan operation;

the nozzles included in each of the p nozzle groups are arranged at a fixed nozzle pitch k×D in the direction perpendicular to the direction of the main scan; and a feed amount of a positioning sub-scan feed is {Lrt−N×k×(p−2)}×D, when Lrt represents a number of main scan lines counted from a main scan line immediately below to a main scan line where a lower end nozzle of the upper end nozzle group is positioned in a state where a unit scan operation executed immediately before the positioning feed has ended, to a main scan line of a lower end of the blank area.

17. A printing apparatus for printing by forming dots by ejecting drops of ink from a nozzle and depositing them on a printing medium, comprising:

a print head which has a nozzle group comprising N (where N is an integer of 2 or greater) nozzles for ejecting drops of ink which are arrayed at a nozzle pitch D which is equivalent to the main scan line pitch D;

a main scan driving unit for performing a main scan which moves at least one of the print head and the printing medium;

a sub-scan driving unit for performing a sub-scan which moves at least one of the print head and the printing medium in a sub-scan direction that intersects with a direction of the main scan; and a control unit for controlling the print head, the main scan driving unit and the sub-scan driving unit, wherein the printing apparatus reproduces first and second dot recording areas in which dots are to be formed, and a blank area inserted between the first and second dot recording areas in the sub-scan direction, wherein the printing apparatus comprises:

a dot recording area recording unit configured to perform a unit scan operation which comprises a single main scan for forming dots on main scan lines of the first dot recording area, while executing an inter-band sub-scan according to a predetermined feed amount SSb between the respective unit scan operations; and a positioning sub-scan feed unit configured to carry out a positioning sub-scan feed to obtain a relative position at which a position of an upper end nozzle of the N nozzles coincides with a position of an upper end main scan line of the second dot recording area in the sub-scan direction, after completing the forming of dots in the first dot recording area.

18. A printing apparatus according to claim 17, wherein a feed amount of the positioning sub-scan feed is (SSb+Lr)×D, when Lr represents a number of main scan lines counted from a main scan line immediately below to a main scan line where a lower end nozzle of nozzles used in the unit scan operation is positioned in a state where the unit scan operation executed immediately before the positioning feed has ended, to a lower end main scan line of the blank area.

19. A printing apparatus according to claim 17, wherein the positioning sub-scan feed unit executes the positioning sub-scan feed, only when a specific main scan line is included in the blank area and a number of main scan lines Lr is N or more, the specific main scan line being a line positioned immediately below to a main scan line where a lower end nozzle of nozzles used in the unit scan operation is positioned when an unit scan operation executed immediately before the positioning sub-scan has ended, Lr being a number of main scan lines counted from the specific main scan line to a main scan line at a lower end of the blank area.

20. A printing apparatus according to claim 19, wherein a feed amount of the positioning sub-scan feed is (SSb+Lr)×D.

21. A printing apparatus for printing by forming dots by ejecting drops of ink from a nozzle and depositing them on a printing medium, comprising:

a print head which has a plurality of nozzle groups each comprising a plurality of nozzles for ejecting drops of ink which are arrayed at a nozzle pitch D which is equivalent to the main scan line pitch D, the plurality of nozzle groups including a lower end nozzle group whose upper end nozzle is positioned at a lowermost place among upper end nozzles of the plurality of nozzle groups;

a main scan driving unit for performing a main scan which moves at least one of the print head and the printing medium;

a sub-scan driving unit for performing a sub-scan which moves at least one of the print head and the printing medium in a sub-scan direction that intersects with a direction of the main scan; and a control unit for controlling the print head, the main scan driving unit and the sub-scan driving unit, wherein the printing apparatus reproduces first and second dot recording areas in which dots are to be formed, and a blank area inserted between the first and second dot recording areas in the sub-scan direction, wherein the printing apparatus comprises:

a dot recording area recording unit configured to perform a unit scan operation which comprises a single main scan for forming dots on main scan lines of the first dot recording area, while executing an inter-band sub-scan according to a predetermined feed amount SSb between the respective unit scan operations; and a positioning sub-scan feed unit configured to carry out a positioning sub-scan feed to obtain a relative position at which a position of an upper end nozzle of the lower end nozzle group coincides with a position of an upper end main scan line of the second dot recording area in the sub-scan direction, after completing the forming of dots in the first dot recording area.

22. A printing apparatus according to claim 21, wherein the positioning sub-scan feed unit comprises a band count unit, a line count unit, and a positioning sub-scan feed execution unit, a band count unit being configured to perform operations of:

(i) setting a parameter i at one;

(ii) determining whether or not an aggregate of main scan lines contains a pixel to be recorded with an ink dot, the aggregate of main scan lines being lines that are to be printed by the nozzle groups when it is assumed that a sub-scan of feed amount of (SSb×i) and the unit scan operation are to be executed;

(iii) incrementing the parameter i by one; and (iv) repeating the operations (ii) and (iii) until the aggregate of main scan lines containing a pixel to be recorded is found, the line count unit being configured to count a number of inner-band blank lines in the aggregate of main scan lines to be decided to contain a pixel to be recorded a dot, the inner-band blank lines being consecutive main scan lines that do not contain a pixel to be recorded with an ink dot and are lined up without gaps in the sub-scan direction from a top of the aggregate of main scan lines, a positioning sub-scan feed execution unit being configured to execute the positioning sub-scan feed of feed amount $\{SSb\times(i_0-1)+j_0\}$, where $i_0$ is the i when the aggregate of main scan lines containing a pixel to be recorded is found and $j_0$ is a number of the inner-band blank lines.

23. A printing apparatus according to claim 21, wherein the nozzle groups are positioned such that they do not overlap one another in a direction perpendicular to the direction of the main scan, and comprise p (where p is an integer of 2 or greater) nozzle groups for ejecting drops of ink of mutually different colors.

24. A printing apparatus according to claim 23, wherein the p nozzle groups each comprise N (where N is an integer of 2 or greater) nozzles;

the nozzles included in each of the p nozzle groups are arranged at a fixed nozzle pitch D in the direction perpendicular to the direction of the main scan; and the positioning sub-scan feed unit executes the positioning sub-scan feed, only when a width of the blank area in the direction perpendicular to the direction of the main scan is greater than $\{N\times(p-1)\}\times D$.

25. A printing apparatus according to claim 23, wherein the p nozzle groups each comprise N (where N is an integer of 2 or greater) nozzles;

the p nozzle groups include an upper end nozzle group including an uppermost nozzle of nozzles used in the unit scan operation;

the nozzles included in each of the p nozzle groups are arranged at a fixed nozzle pitch D in the direction perpendicular to the direction of the main scan; and a feed amount of a positioning sub-scan feed is $\{Lrt-N\times(p-2)\}\times D$, when Lrt represents a number of main scan lines counted from a main scan line immediately below to a main scan line where a lower end nozzle of the upper end nozzle group is positioned in a state where a unit scan operation executed immediately before the positioning feed has ended, to a main scan line of a lower end of the blank area.

26. A printing apparatus for printing by forming dots by ejecting drops of ink from a nozzle and depositing them on a printing medium, comprising:

a print head which has a nozzle group comprising N (where N is an integer of 2 or greater) nozzles for ejecting drops of ink which are arrayed at a nozzle pitch k×D that is k times (where k is an integer of 2 or greater) a main scan line pitch D;

a main scan driving unit for performing a main scan which moves at least one of the print head and the printing medium;

a sub-scan driving unit for performing a sub-scan which moves at least one of the print head and the printing medium in a sub-scan direction that intersects with a direction of the main scan; and a control unit for controlling the print head, the main scan driving unit and the sub-scan driving unit, wherein the printing apparatus reproduces first and second dot recording areas in which dots are to be formed, and a blank area inserted between the first and second dot recording areas in the sub-scan direction, wherein the printing apparatus comprises:

a dot recording area recording unit configured to perform a unit scan operation for forming dots on main scan lines of the first dot recording area, the unit scan operation comprising k main scans and (k−1) sub-scans executed between the respective main scans by a predetermined first feed amount SSm, while executing inter-band sub-scans by a predetermined second feed amount SSb between unit scan operations; and a positioning sub-scan feed unit configured to carry out a positioning sub-scan feed to obtain a relative position where an upper end main scan line of a unit band coincides with a main scan line of an upper end of the second dot recording area, after completing the forming of dots in the first dot recording area, the unit band being a bundle of consecutive main scan lines lined up without gaps in the sub-scan direction that are to be printed by the nozzle group when it is assumed that the unit scan operation is executed once after the positioning sub-scan feed.

27. A printing apparatus according to claim 26, wherein a feed amount of the positioning sub-scan feed is $(SSb+Lr)\times D$, when Lr represents a number of main scan lines counted from a main scan line immediately below to a main scan line where a lower end nozzle of nozzles used in the unit scan operation is positioned in a state where a unit scan operation executed immediately before the positioning feed has ended, to a main scan line of a lower end of the blank area.

28. A printing apparatus according to claim 26, wherein the positioning sub-scan feed unit executes the positioning sub-scan feed only when a specific main scan line is included in the blank area and a number of main scan lines Lr is N×k or more, the specific main scan line being a line positioned immediately below to a main scan line where a lower end nozzle of nozzles used in the unit scan operation is positioned when an unit scan operation executed immediately before the positioning sub-scan has ended, Lr being a number of main scan lines counted from the specific main scan line to a main scan line at a lower end of the blank area.

29. A printing apparatus according to claim 28, wherein a feed amount of the positioning sub-scan feed is $(SSb+Lr)\times D$.

30. A printing apparatus for printing by forming dots by ejecting drops of ink from a nozzle and depositing them on a printing medium, comprising:

a print head which has a plurality of nozzle groups each comprising a plurality of nozzles for ejecting drops of ink which are arrayed at a nozzle pitch k×D that is k times (where k is an integer of 2 or greater) a main scan line pitch D, the plurality of nozzle groups including a lower end nozzle group whose upper end nozzle is positioned at a lowermost place among upper end nozzles of the plurality of nozzle groups;

a main scan driving unit for performing a main scan which moves at least one of the print head and the printing medium;

a sub-scan driving unit for performing a sub-scan which moves at least one of the print head and the printing medium in a sub-scan direction that intersects with a direction of the main scan; and a control unit for controlling the print head, the main scan driving unit and the sub-scan driving unit, wherein the printing apparatus reproduces first and second dot recording areas in which dots are to be formed, and a blank area inserted between the first and second dot recording areas in the sub-scan direction, wherein the printing apparatus comprises:

a dot recording area recording unit configured to perform a unit scan operation for forming dots on main scan lines of the first dot recording area, the unit scan operation comprising k main scans and (k−1) sub-scans executed between the respective main scans by a predetermined first feed amount SSm, while executing inter-band sub-scans by a predetermined second feed amount SSb between unit scan operations; and a positioning sub-scan feed unit configured to carry out a positioning sub-scan feed to obtain a relative position where an upper end main scan line of a unit band coincides with a main scan line of an upper end of the second dot recording area, after completing the forming of dots in the first dot recording area, the unit band being a bundle of consecutive main scan lines lined up without gaps in the sub-scan direction that are to be printed by the lower end nozzle group when it is assumed that the unit scan operation is executed once after the positioning sub-scan feed.

31. A printing apparatus according to claim 30, wherein the positioning sub-scan feed unit comprises a band count unit, a line count unit, and a positioning sub-scan feed execution unit, a band count unit being configured to perform operations of:

(i) setting a parameter i at one;

(ii) determining whether or not an aggregate of main scan lines contains a pixel to be recorded with an ink dot, the aggregate of main scan lines being lines that are to be printed by the nozzle groups when it is assumed that a sub-scan of feed amount of $\{SSb\times i+SSm\times(k-1)\times(i-1)\}$ and the unit scan operation are to be executed;

(iii) incrementing the parameter i by one; and (iv) repeating the operations (ii) and (iii) until the aggregate of main scan lines containing a pixel to be recorded is found, the line count unit being configured to count a number of inner-band blank lines in the aggregate of main scan lines to be decided to contain a pixel to be recorded a dot, the inner-band blank lines being consecutive main scan lines that do not contain a pixel to be recorded with an ink dot and are lined up without gaps in the sub-scan direction from a top of the aggregate of main scan lines, a positioning sub-scan feed execution unit being configured to execute the positioning sub-scan feed of feed amount $\{SSb+SSm\times(k-1)\}\times(i_0-1)+j_0$, where $i_0$ is the i when the aggregate of main scan lines containing a pixel to be recorded is found and $j_0$ is a number of the inner-band blank lines.

32. A printing apparatus according to claim 30, wherein the nozzle groups are positioned such that they do not overlap one another in a direction perpendicular to the direction of the main scan, and comprise p (where p is an integer of 2 or greater) nozzle groups for ejecting drops of ink of mutually different colors.

33. A printing apparatus according to claim 32, wherein the p nozzle groups each comprise N (where N is an integer of 2 or greater) nozzles;

the nozzles included in each of the p nozzle groups are arranged at a fixed nozzle pitch k×D in the direction perpendicular to the direction of the main scan; and the positioning sub-scan feed unit executes the positioning sub-scan feed only when a width of the blank area in the direction perpendicular to the direction of the main scan is greater than $\{N\times k\times(p-1)\}\times D$.

34. A printing apparatus according to claim 32, wherein the p nozzle groups each comprise N (where N is an integer of 2 or greater) nozzles;

the p nozzle groups include an upper end nozzle group including an uppermost nozzle of nozzles used in the unit scan operation;

the nozzles included in each of the p nozzle groups are arranged at a fixed nozzle pitch k×D in the direction perpendicular to the direction of the main scan; and a feed amount of a positioning sub-scan feed is $\{Lrt-N\times k\times(p-2)\}\times D$, when Lrt represents a number of main scan lines counted from a main scan line immediately below to a main scan line where a lower end nozzle of the upper end nozzle group is positioned in a state where a unit scan operation executed immediately before the positioning feed has ended, to a main scan line of a lower end of the blank area.

35. A computer program product for printing on a printing medium by depositing drops of ink to form dots on the printing medium using a computer, the computer being connected with a printing device having a nozzle group comprising N (where N is an integer of 2 or greater) nozzles for ejecting drops of ink which are arrayed at a nozzle pitch D equivalent to a main scan line pitch D, wherein computer program product is for reproducing first and second dot recording areas in which dots are to be formed, and a blank area inserted between the first and second dot recording areas in the sub-scan direction, the computer program product comprising:

a computer readable medium; and a computer program stored on the computer readable medium, the computer program comprising:

a first program for causing the computer to perform a unit scan operation which comprises a single main scan for forming dots on main scan lines of the first dot recording area, while executing an inter-band sub-scan according to a predetermined feed amount SSb between the respective unit scan operations; and a second program for causing the computer to carry out a positioning sub-scan feed to obtain a relative position at which a position of an upper end nozzle of the N nozzles coincides with a position of an upper end main scan line of the second dot recording area in the sub-scan direction, after completing the forming of dots in the first dot recording area.

36. A computer program product for printing on a printing medium by depositing drops of ink to form dots on the printing medium using a computer, the computer being connected with a printing device having a plurality of nozzle groups each comprising a plurality of nozzles for ejecting drops of ink which are arrayed at a nozzle pitch D equivalent to a main scan line pitch D, the plurality of nozzle groups including a lower end nozzle group whose upper end nozzle is positioned at a lowermost place among upper end nozzles of the plurality of nozzle groups, wherein computer program product is for reproducing first and second dot recording areas in which dots are to be formed, and a blank area inserted between the first and second dot recording areas in the sub-scan direction, the computer program product comprising:

a computer readable medium; and a computer program stored on the computer readable medium, the computer program comprising:

a first program for causing the computer to perform a unit scan operation which comprises a single main scan for forming dots on main scan lines of the first dot recording area, while executing an inter-band sub-scan according to a predetermined feed amount SSb between the respective unit scan operations; and a second program for causing the computer to carry out a positioning sub-scan feed to obtain a relative position at which a position of an upper end nozzle of the lower end nozzle group coincides with a position of an upper end main scan line of the second dot recording area in the sub-scan direction, after completing the forming of dots in the first dot recording area.

37. A computer program product for printing on a printing medium by depositing drops of ink to form dots on the printing medium using a computer, the computer being connected with a printing device having a nozzle group comprising N (where N is an integer of 2 or greater) nozzles for ejecting drops of ink which are arrayed at a nozzle pitch k×D that is k times (where k is an integer of 2 or greater) a main scan line pitch D, wherein computer program product is for reproducing first and second dot recording areas in which dots are to be formed, and a blank area inserted between the first and second dot recording areas in the sub-scan direction, the computer program product comprising:

a computer readable medium; and a computer program stored on the computer readable medium, the computer program comprising:

a first program for causing the computer to perform a unit scan operation for forming dots on main scan lines of the first dot recording area, the unit scan operation comprising k main scans and (k−1) sub-scans executed between the respective main scans by a predetermined first feed amount SSm, while executing inter-band sub-scans by a predetermined second feed amount SSb between unit scan operations; and a second program for causing the computer to carry out a positioning sub-scan feed for executing a sub-scan to obtain a relative position where an upper end main scan line of a unit band coincides with a main scan line of an upper end of the second dot recording area, after completing the forming of dots in the first dot recording area, the unit band being a bundle of consecutive main scan lines lined up without gaps in the sub-scan direction that are to be printed by the nozzle group when it is assumed that the unit scan operation is executed once after the positioning sub-scan feed.

38. A computer program product for printing on a printing medium by depositing drops of ink to form dots on the printing medium using a computer, the computer being connected with a printing device having a plurality of nozzle groups each comprising a plurality of nozzles for ejecting drops of ink which are arrayed at a nozzle pitch k×D that is k times (where k is an integer of 2 or greater) a main scan line pitch D, the plurality of nozzle groups including a lower end nozzle group whose upper end nozzle is positioned at a lowermost place among upper end nozzles of the plurality of nozzle groups, wherein computer program product is for reproducing first and second dot recording areas in which dots are to be formed, and a blank area inserted between the first and second dot recording areas in the sub-scan direction, the computer program product comprising:

a computer readable medium; and a computer program stored on the computer readable medium, the computer program comprising:

a first program for causing the computer to perform a unit scan operation for forming dots on main scan lines of the first dot recording area, the unit scan operation comprising k main scans and (k−1) sub-scans executed between the respective main scans by a predetermined first feed amount SSm, while executing inter-band sub-scans by a predetermined second feed amount SSb between unit scan operations; and a second program for causing the computer to carry out a positioning sub-scan feed to obtain a relative position where an upper end main scan line of a unit band coincides with a main scan line of an upper end of the second dot recording area, after completing the forming of dots in the first dot recording area, the unit band being a bundle of consecutive main scan lines lined up without gaps in the sub-scan direction that are to be printed by the lower end nozzle group when it is assumed that the unit scan operation is executed once after the positioning sub-scan feed.

39. A printing control device configured to produce printing data to be supplied to a printing device for printing on a printing medium by depositing drops of ink to form dots on the printing medium, the printing device comprising a print head which has a plurality of nozzle groups each comprising a plurality of nozzles for ejecting drops of ink which are arrayed at a nozzle pitch D which is equivalent to the main scan line pitch D, the plurality of nozzle groups including a lower end nozzle group whose upper end nozzle is positioned at a lowermost place among upper end nozzles of the plurality of nozzle groups;

wherein an image data to be printed comprises:

a first dot recording area data for a first dot recording area in which dots are to be formed, a blank area data for a blank area adjacent to the first dot recording area with a sub-scan direction in which dots are not formed, and a second dot recording area data for a second dot recording area adjacent to the clank area with the sub-scan direction in which dots are to be formed, wherein the printing control device comprises:

a band recording data generating unit configured to generate band recording data for causing the printing device to perform a unit scan operation which comprises a single main scan for forming dots on main scan lines of the first dot recording area, while executing an inter-band sub-scan according to a predetermined feed amount SSb between the respective unit scan operations; and a positioning sub-scan feed data generating unit configured to generate positioning sub-scan feed data for causing the printing device to carry out a positioning sub-scan feed to obtain a relative position, at which a position of an upper end nozzle of a lower end nozzle group coincides with a position of an upper end main scan line of the second dot recording area in the sub-scan direction, after completing the forming of dots in the first dot recording area.

40. A printing control device according to claim 39, wherein the positioning sub-scan feed data generating unit comprises a band count unit, a line count unit, and a positioning sub-scan feed execution unit, a band count unit being configured to perform operations of:

(i) setting a parameter i at one;

(ii) determining whether or not an aggregate of main scan lines contains a pixel to be recorded with an ink dot, the aggregate of main scan lines being lines that are to be printed by the nozzle groups when it is assumed that a sub-scan of feed amount of (SSb×i) and the unit scan operation are to be executed;

(iii) incrementing the parameter i by one; and (iv) repeating the operations (ii) and (iii) until the aggregate of main scan lines containing a pixel to be recorded is found, the line count unit being configured to count a number of inner-band blank lines in the aggregate of main scan lines to be decided to contain a pixel to be recorded a dot, the inner-band blank lines being consecutive main scan lines that do not contain a pixel to be recorded with an ink dot and are lined up without gaps in the sub-scan direction from a top of the aggregate of main scan lines, a positioning feed amount setting unit being configured to set the feed amount of the positioning sub-scan feed $\{SSb\times(i_0-1)+j_0\}$, where $i_0$ is the i when it is decided that the aggregate of main scan lines contains a pixel to be recorded a dot first and $j_0$ is a number of the inner-band blank lines.

41. A printing control device configured to produce printing data to be supplied to a printing device for printing on a printing medium by depositing drops of ink to form dots on the printing medium, the printing device comprising a print head, a plurality of nozzle groups each comprising a plurality of nozzles for ejecting drops of ink which are arrayed at a nozzle pitch k×D that is k times (where k is an integer of 2 or greater) a main scan line pitch D, the plurality of nozzle groups including a lower end nozzle group whose upper end nozzle is positioned at a lowermost place among upper end nozzles of the plurality of nozzle groups;

wherein an image data to be printed comprises:

a first dot recording area data for a first dot recording area in which dots are to be formed, a blank area data for a blank area adjacent to the first dot recording area with a sub-scan direction in which dots are not formed, and a second dot recording area data for a second dot recording area adjacent to the clank area with the sub-scan direction in which dots are to be formed, wherein the printing control device comprises:

a band recording data generating unit configured to generate band recording data for causing the printing device to perform a unit scan operation for forming dots on main scan lines of the first dot recording area, the unit scan operation comprising k main scans and (k−1) sub-scans executed between the respective main scans by a predetermined first feed amount SSm, while executing inter-band sub-scans by a predetermined second feed amount SSb between unit scan operations; and a positioning sub-scan feed data generating unit configured to generate positioning sub-scan feed data for causing the printing device to carry out a positioning sub-scan feed to obtain a relative position where an upper end main scan line of a unit band coincides with a main scan line of an upper end of the second dot recording area, after completing the forming of dots in the first dot recording area, the unit band being a bundle of consecutive main scan lines lined up without gaps in the sub-scan direction that are to be printed by the lower end nozzle group when it is assumed that the unit scan operation is executed once after the positioning sub-scan feed.

42. A printing control device according to claim 41, wherein the positioning sub-scan feed data generating unit comprises a band count unit, a line count unit, and a positioning sub-scan feed execution unit, a band count unit being configured to perform operations of:

(i) setting a parameter i at one;

(ii) determining whether or not an aggregate of main scan lines contains a pixel to be recorded with an ink dot, the aggregate of main scan lines being lines that are to be printed by the nozzle groups when it is assumed that a sub-scan of feed amount of $\{SSb\times i+SSm\times(k-1)\times(i-1)\}$ and the unit scan operation are to be executed;

(iii) incrementing the parameter i by one; and (iv) repeating the operations (ii) and (iii) until the aggregate of main scan lines containing a pixel to be recorded is found, the line count unit being configured to count a number of inner-band blank lines in the aggregate of main scan lines to be decided to contain a pixel to be recorded a dot, the inner-band blank lines being consecutive main scan lines that do not contain a pixel to be recorded with an ink dot and are lined up without gaps in the sub-scan direction from a top of the aggregate of main scan lines, a positioning feed amount setting unit being configured to set the feed amount of the positioning sub-scan feed $\{SSb+SSm\times(k-1)\}\times(i_0-1)+j_0$, where $i_0$ is the i when it is decided that the aggregate of main scan lines contains a pixel to be recorded a dot first and $j_0$ is a number of the inner-band blank lines.

* * * * *